US007171151B2

(12) United States Patent
Endo et al.

(10) Patent No.: US 7,171,151 B2
(45) Date of Patent: Jan. 30, 2007

(54) IMAGE FORMING METHOD AND APPARATUS HAVING IMPROVED CLEANING MEANS

(75) Inventors: Isao Endo, Hachioji (JP); Hiroyuki Yamada, Hachioji (JP)

(73) Assignee: Konica Corporation, Tokyo (JP)

( * ) Notice: Subject to any disclaimer, the term of this patent is extended or adjusted under 35 U.S.C. 154(b) by 942 days.

(21) Appl. No.: 10/266,540

(22) Filed: Oct. 8, 2002

(65) Prior Publication Data

US 2003/0118383 A1 Jun. 26, 2003

(30) Foreign Application Priority Data

Oct. 16, 2001 (JP) ..... 2001-318071

(51) Int. Cl.
*G03G 21/00* (2006.01)

(52) U.S. Cl. ..... 399/349

(58) Field of Classification Search ..... None
See application file for complete search history.

(56) References Cited

U.S. PATENT DOCUMENTS

| | | | | |
|---|---|---|---|---|
| 5,481,351 | A | 1/1996 | Kawai et al. | |
| 5,617,194 | A * | 4/1997 | Morishita et al. | 399/349 |
| 5,765,088 | A * | 6/1998 | Nakayama et al. | 399/350 |
| 6,153,346 | A | 11/2000 | Machata et al. | |
| 2003/0026630 | A1* | 2/2003 | Namiki | 399/299 |
| 2004/0136758 | A1* | 7/2004 | Kera et al. | 399/299 |

FOREIGN PATENT DOCUMENTS

| | | | |
|---|---|---|---|
| JP | 5876873 | | 5/1983 |
| JP | 01133091 | A * | 5/1989 |
| JP | 5333757 | | 12/1993 |
| JP | 09204126 | A * | 8/1997 |
| JP | 9212057 | | 8/1997 |

OTHER PUBLICATIONS

European Search Report EP 02 25 7078.
1 pg. English Abstract only.

* cited by examiner

*Primary Examiner*—Quana Grainger
(74) *Attorney, Agent, or Firm*—Lucas & Mercanti, LLP

(57) ABSTRACT

An image forming apparatus structured with an image carrier; a developing device for making a toner image by using a toner having resin particles, which are obtained through particle formation in an aqueous medium; a transfer device for transferring the toner image onto a transfer material; and a cleaning device for removing residual toner remaining on the image carrier after transferring, wherein the cleaning device has: a cleaning roller having a conductive or semi-conductive resilient body; a cleaning blade made of a resilient material and provided downstream the cleaning roller; a power source to apply a bias voltage on the cleaning roller; and a collecting member to collect the toner removed by the cleaning roller; and wherein the absolute value of the charge amount of the toner used in the image forming apparatus is between 20–50 μC/g.

17 Claims, 14 Drawing Sheets

FIG. 4 ( a )
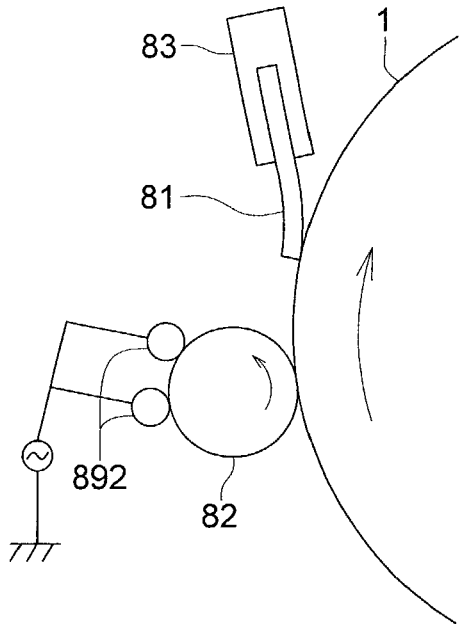
FIG. 4 ( b )
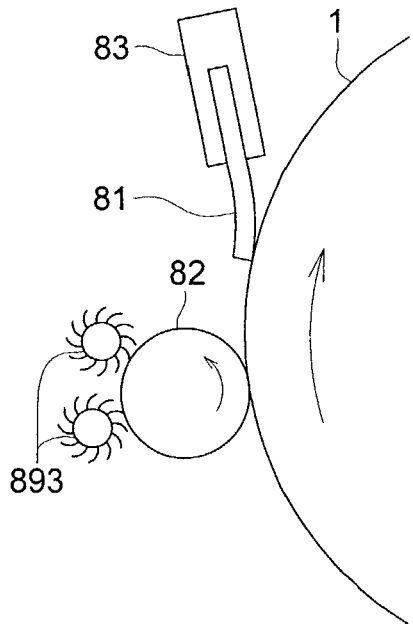
FIG. 4 ( c )
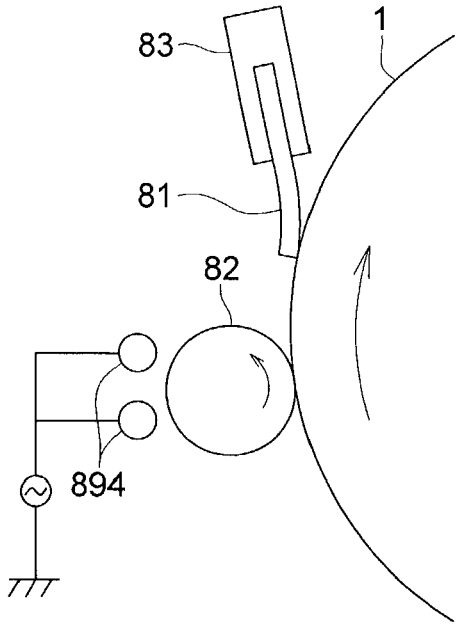

FIG. 6 ( a )
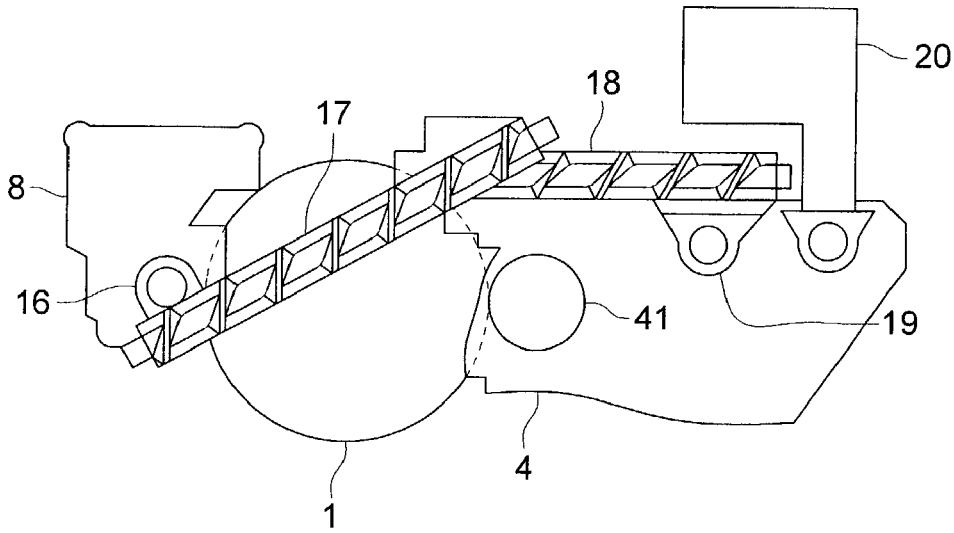
FIG. 6 ( b )
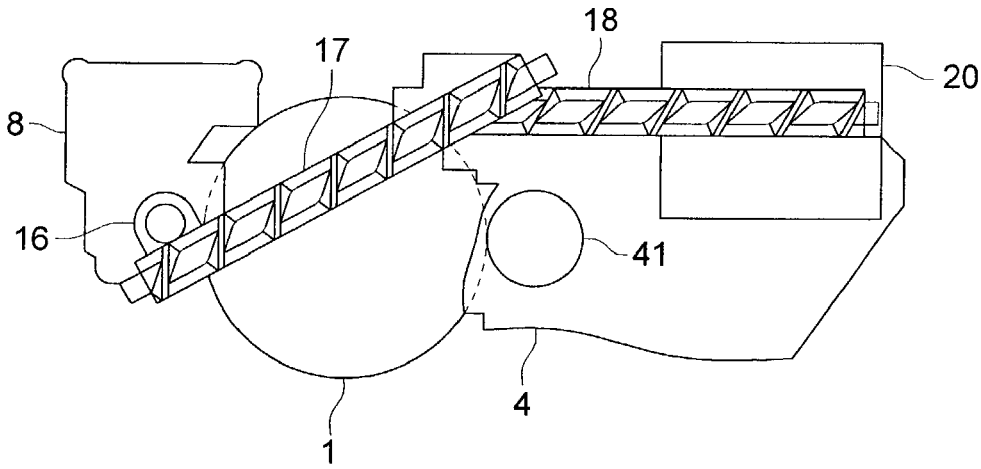

FIG. 10 ( a )
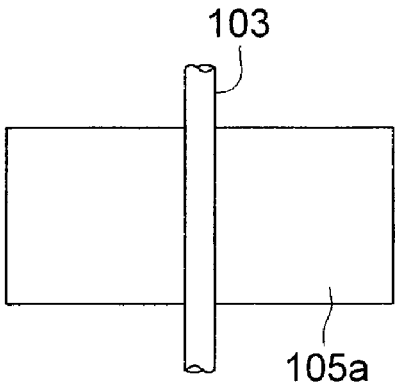
FIG. 10 ( b )
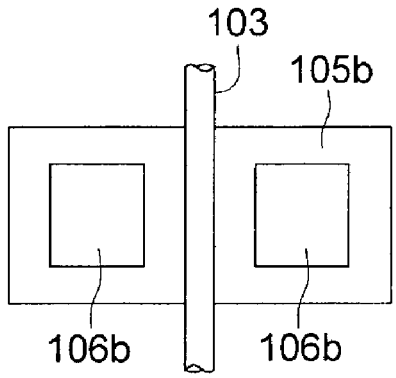
FIG. 10 ( c )
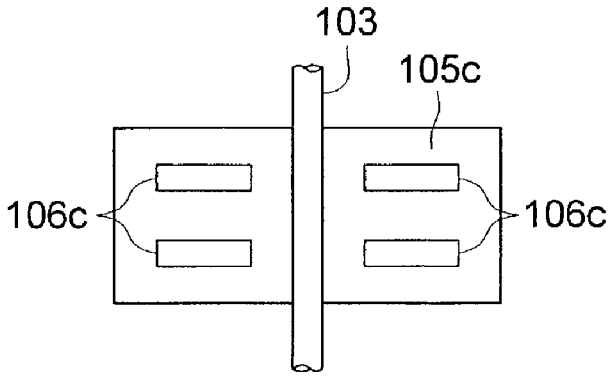
FIG. 10 ( d )
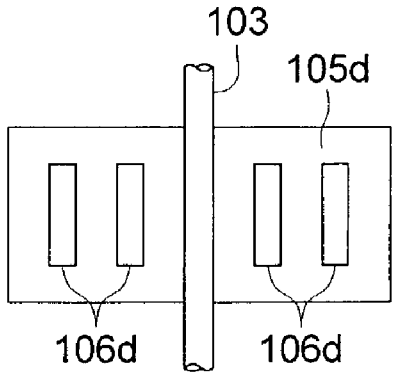

FIG. 17 ( a )
TONER PARTICLE
HAVING NO CORNER
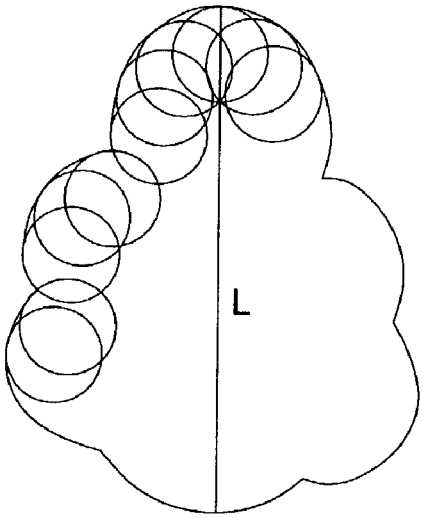
FIG. 17 ( b )
TONER PARTICLE
HAVING CORNERS
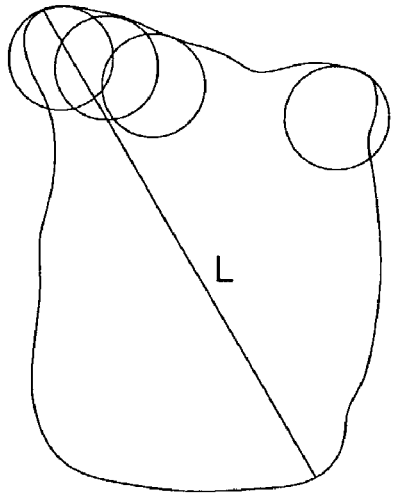
FIG. 17 ( c )
TONER PARTICLE
HAVING CORNERS
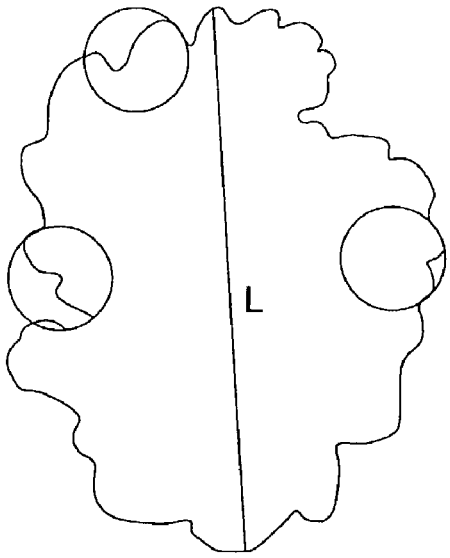

IMAGE FORMING METHOD AND APPARATUS HAVING IMPROVED CLEANING MEANS

BACK GROUND OF THE INVENTION

The present invention relates to an image forming method and apparatus having a cleaning means that is applied to an electrophotographic process.

In recent years, in the field of image forming technology, where an electrophotographic process is applied to form images, downsizing of toner particles is promoted in order to attain high image quality. By the downsizing of toner particles, image resolution improves and forming sharper images can be possible, however, the following problems arise in the cleaning process.

As the toner particle size becomes smaller, the adhesive force between the toner and the image carrier member becomes larger comparatively, hence removal of un-transferred toner or residual toner after transfer becomes difficult, which causes generation of cleaning failure and inferior image quality if the cleaning technology depends only on the conventional cleaning blade.

Especially, when a so-called polymerization toner, produced by the polymerization method (an emulsion polymerization method or a suspension polymerization method) is used, in addition to the size factor of toner particles, the form of the toner particle tends to be closer to a spherical shape. Therefore, toner particles roll on the image carrier member causing frequent cleaning failure since the toner particles slip through the cleaning blade which is called "slipping-through", and which causes a problem of being more difficult to remove residual toner on the image carrier member. There are studies aimed at solving these problems of cleaning failure accompanied by the downsizing of toner particles. For example, Tokkaihei No. 11-52808 discloses a cleaning technology in which, as the material constituting a cleaning blade, conductive or semi-conductive rubber is used, and a voltage, of opposite polarity to the residual toner, is applied to the cleaning blade in order to apply a mechanical as well as an electrostatic removal force to the residual toner.

Further, Tokkaihei No. 3-189675 discloses a cleaning system wherein a brush roller, made of conductive material on which a voltage can be applied, is installed upstream of the cleaning blade in the direction of movement of a latent image carrier, and thereby, the cleaning efficiency has been improved by both mechanical cleaning effect and electrostatic cleaning effect.

However, in the above cleaning technologies, since the potential of the image carrier surface varies by portions (image portion, non-image portion, non-transfer portion), if a certain fixed voltage is applied to the cleaning blade, unevenness of toner removal arises. In order to overcome this problem, the applied voltage was made higher, however, a discharge and a charge injection to the image carrier were generated causing potential failure and deterioration of the image carrier.

Further, in downsizing technologies of toner particles, the smaller the size of the toner particles is the higher the charging property becomes, therefore, it is natural that in the image forming process of using a small particle size toner, an effective removal of residual toner on the image carrier after the transfer, is accompanied by greater difficulty.

Furthermore, it is assumed that the toner, manufactured by the abovementioned polymerizing process, contains impurities such as salt used in the polymerizing process, since the toner is obtained through a resin particle manufacturing process with a particle forming in an aqueous medium. These impurities, attached to the surface of toner particles, are also assumed to make the toner removal from the image carrier surface more difficult.

The polymerized toner, obtained through the particle forming in the aqueous medium, is not only difficult to be removed from the image carrier, but is also difficult to remove from the cleaning member, since it clings to the cleaning member even if it is removed from the image carrier. This toner also deposits itself onto the cleaning member such as a blade, after which the deposited toner drops to cause smudged images or a dirty machine. Further, when removing the attached toner from the cleaning member, an extremely large load is applied compared to the case of pulverized toner, and then due to the excessive stress on the toner, reuse or recycling of the collected toner becomes very difficult.

Although the recycle technology of the collected toner is extremely important from the viewpoint of environmental protection, it remains as a very difficult objective to attain for the small sized polymerized toner particles obtained through the particle formation in the aqueous medium. Especially when a toner collecting member, such as brush rollers for toner recycling, which are known conventionally, is applied to the small sized polymerized toner particle, due to extremely high charging property compared to the pulverized toner, the absorption power to the oppositely charged brush roller becomes excessively large and this leads to the problem of insufficient toner collection.

Further, in the case where the brush roller etc. brushes the surface of image carrier, there exist a problem that the toner itself works as an abrasive to easily generate flaws on the surface of the image carrier. And when inorganic particles such as silica and titania, which are generally added to the toner and have a property of easily being scattered, are deposited on the image carrier, roller or the brush, there exists a problem in that these inorganic particles damage the image carrier or the cleaning blade provided downstream.

These flaws on the image carrier and damage of cleaning blade cause image defects such as white streak or black streaks, and the cleaning method using a brush roller or a resilient roller applied a bias voltage, in particular, remarkably has this tendency, since the additives added to the toner are easily released electrostatically.

An object of the present invention is to provide an image forming apparatus and an image forming method exhibiting stable cleaning properties for a long time period and not generating defective images, even in the image forming process using a polymerized toner that comprises resin particles obtained through particle formation in an aqueous medium, and having a high charge amount.

Another object of the present invention is to provide an image forming apparatus and an image forming method that are capable of assuredly collecting by a collecting member, and reusing small sized polymerized toner having high charging property.

SUMMARY OF THE INVENTION

The inventors found out the present invention as the result of dedicated study to solve the above problems. Namely, the present invention attained the objects to make possible the cleaning of small sized polymerized toner by inventing a cleaning technology that combines electrical cleaning and mechanical cleaning under appropriate conditions, which, using conventional technology, was difficult to remove the residual toner from the image carrier.

Further, the present invention established a recycling technology for polymerized toner where the toner removed from the image carrier, collected and returned to a developing means is used again for image formation.

Further, by the present invention it was also found that effective cleaning is possible for toner with high charge amount, which was difficult to remove from the image carrier by conventional technology.

Further, in developing the present invention it was found that regarding the toner obtained through particle formation in an aqueous medium and used in the present invention, the shape of the toner, the particle size distribution or existence of corners on the toner particle surface greatly affect the charging property of the toner. Further improvement of cleaning property and recycling technology were invented by using polymerized toner in which the above conditions were controlled. Namely the objectives of the present invention are attained by any one of the following structures.

(1) An image forming apparatus comprising:

an image carrier having a photosensitive surface layer;

a developing device for making a toner image by developing a latent image formed on the image carrier by using a toner comprising resin particles which are obtained through particle formation in an aqueous medium;

a transfer device for transferring the toner image on the image carrier to a transfer material; and a cleaning device for removing residual toner remaining on the image carrier after transferring;

wherein the cleaning device comprises:

a cleaning roller having a conductive or semi-conductive resilient body;

a cleaning blade made of a resilient material and provided downstream in the moving direction of the image carrier;

a power source to apply a bias voltage on the cleaning roller; and a collecting member to collect the toner removed by the cleaning roller;

and wherein the absolute value of the charge amount of the toner used in the image formation apparatus is not less than 20 μC/g and not more than 50 μC/g.

(2) The image forming apparatus of (1), wherein the cleaning device comprises a plurality of collecting members to collect toner removed by the cleaning roller.

(3) The image forming apparatus according to (1) or (2), wherein the power source, to apply a bias voltage on the cleaning roller, is a constant current type.

(4) The image forming apparatus according to (1), (2) or (3), further comprises a toner recycling device for returning the toner collected by the collecting member to the developing device to make a toner image by developing the latent image formed on the image carrier.

(5) The image forming apparatus according to any one of (1) to (4), wherein the toner used in the image forming apparatus has a degree of circularity not less than 0.930 and not more than 1.000.

(6) The image forming apparatus according to any one of (1) to (4), wherein Dv and Dp of the toner used in the image forming apparatus have the relation expressed in the following formula: 1.3−Dv/Dp−1.0 wherein, Dv is volume average particle diameter, and Dp is particle number average of the particle diameter.

(7) The image forming apparatus according to any one of (1) to (4), wherein the toner used in the image forming apparatus comprises toner particles, which include 50 number % or more of the toner particles having no corner.

(8) The image forming apparatus according to any one of (1) to (7), wherein the toner used in the image forming apparatus comprises toner particles, in which the particle number average of the toner particles is not less than 3 μm and not larger than 9 μm.

(9) The image forming apparatus according to any one of (1) to (8), wherein the toner used in the image forming apparatus comprises toner particles wherein, when D (μm) represents a particle diameter of a toner particle, it is preferable that the sum total (M) of relative frequency (m1) of the toner particles included in the most frequent rank and relative frequency (m2) of toner particles included in the second highest frequent rank is 70% or more, in the histogram showing the particle size distribution of the number basis wherein the horizontal axis is represented by natural logarithm 1 nD and said horizontal axis is divided into plural ranks at an interval of 0.23.

(10) The image forming apparatus according to any one of (1) to (9), wherein the toner used in the image forming apparatus comprises toner particles obtained by association of resin particles in an aqueous medium.

(11) An image forming method comprising:

forming a latent image on an image carrier having a photosensitive surface layer;

making a toner image by developing the latent image with a toner comprising resin particles which are obtained through particle formation in an aqueous medium;

transferring the toner image on the image carrier onto a transfer material;

removing residual toner remaining on the image carrier after transferring; wherein removal of the residual toner is performed by both a cleaning roller having a conductive or semi-conductive resilient body and a cleaning blade made of a resilient material and provided downstream in the moving direction of the image carrier; and collecting toner removed by the cleaning roller; wherein the absolute value of the charge amount of the toner used in the image forming method is not less than 20 μC/g and not more than 50 μC/g.

(12) The image forming method according to (11), wherein the cleaning roller is supplied with a bias voltage by a constant current type power source to remove the residual toner.

(13) The image forming method according to (11) or (12), further comprises a step of returning the toner collected by the toner collecting member to the developing device to make a toner image by developing the latent image formed on the image carrier.

(14) The image forming method according to any one of (11) to (13), wherein the toner used for making the toner image has a degree of circularity not less than 0.930 and not more than 1.000.

(15) The image forming method according to any one of (11) to (13), wherein Dv and Dp of the toner used for making the toner image have the relation expressed in the following formula: 1.3>Dv/Dp>1.0 wherein, Dv is the volume average particle diameter, and Dp is the particle number average of particle diameter.

(16) The image forming method according to any one of (11) to (13), wherein the toner used for making the toner image comprises toner particles, which have 50 number % or more of the toner particles have no corner.

(17) The image forming method according to any one of (11) to (16), wherein the toner used for making the toner image comprises toner particles, the particle number average of the toner particles being not less than 3 μm and not greater than 9 μm.

(18) The image forming method according to any one of (11) to (17), wherein the toner used for making the toner image comprises toner particles wherein, when D (μm) represents a particle diameter of toner particles, the sum total (M) of relative frequency (m1) of the toner particles included in the most frequent rank and relative frequency (m2) of toner particles included in the second highest frequent rank is 70% or more, in the histogram showing the particle size distribution of the number basis wherein the horizontal axis is represented by natural logarithm 1 nD and this horizontal axis is divided into plural ranks at an interval of 0.23.

(19) The image forming method according to any one of (11) to (18), wherein the toner used for making the toner image comprises toner particles obtained by association of resin particles in an aqueous medium.

BRIEF DESCRIPTION OF THE DRAWINGS

FIGS. 4(*a*) to 4(*c*) are illustrations showing examples of collecting members in a cleaning device of the present invention.

FIGS. 6(*a*) and 6(*b*) are schematic views showing examples of a toner recycling system used in the present invention.

FIGS. 10(*a*) to 10(*d*) are schematic views showing examples of agitator vanes.

FIG. 17(*a*) is an illustration showing a toner particle having no corner, while each of FIG. 17(*b*) and FIG. 17(*c*) represents an illustration showing a toner particle having corners.

DETAILED DESCRIPTION OF THE PREFERRED EMBODIMENT

Figure 1:
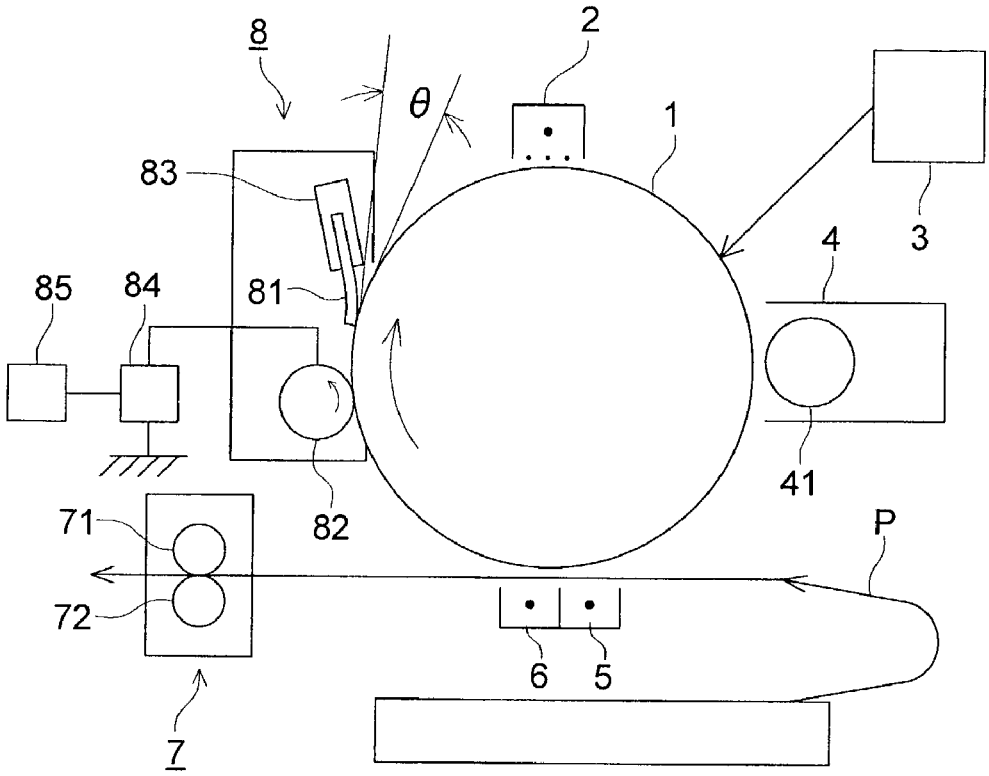
FIG. 1 is a schematic structural diagram showing an embodiment of an image forming apparatus of the present invention.

FIG. 1 shows an embodiment of an image forming apparatus of the present invention. In FIG. 1, a collecting member for toner recycling and a cleaning blade provided at the cleaning roller 82 are not shown in the illustration.

In FIG. 1, numeral 1 shows a photoreceptor as an image carrier.

As a photoreceptor (also referred as an image carrier), an organic photoreceptor having a photoconductive layer in which an organic photoconductive material is dispersed in a resin is preferable from viewpoints of environmental concern and cost.

Numeral 2 shows a charging means for forming an even electrical potential on the photoreceptor 1, by charging the photoreceptor. As a charging means, a scorotron charger having a discharge electrode and a control electrode, and a contact charging device using a voltage applied roller are preferable.

Numeral 3 shows an exposing means for exposing the photoreceptor according to image data. As the exposing means, an optical scanning means is preferable using an optical scanner which uses a laser diode as a light source and constituted of a polygon mirror, lenses, and mirrors, or an optical scanner which has light-emitting diode array and focusing optical fibers. The exposing means 3 exposes the photoreceptor 1 with numerous dots according to image data.

Numeral 4 shows a developing means that contains a single component developer or a dual component developer and transports the developer to a developing region by the developing sleeve 41, which acts as a developer transporting means, and forms a toner image on the photoreceptor 1. On the developing sleeve 41 a direct current bias voltage, which has the same polarity as the charging polarity of the charging means 2, or an alternating current bias voltage, on which a direct current voltage of the same polarity as the charging polarity is superposed, is applied and the exposed area of the photoreceptor 1 is reverse-developed to form the toner image.

Numeral 5 shows a transfer means consisting of a corona charger. The transfer means 5 charges recording sheet P at a polarity opposite the toner on the photoreceptor 1, to transfer the toner image onto the recording sheet P.

Numeral 6 shows a separator means consisting of corona charger that discharges and separates the recording sheet from the photoreceptor 1 by applying an alternating current charging on the transfer sheet.

Numeral 7 shows a fixing unit that fixes the toner image onto the transfer sheet P by applying a heat roller 71 containing a heat source such as a halogen lamp, and a pressure roller 72, which is in pressure contact with the heat roller.

Figure 2:
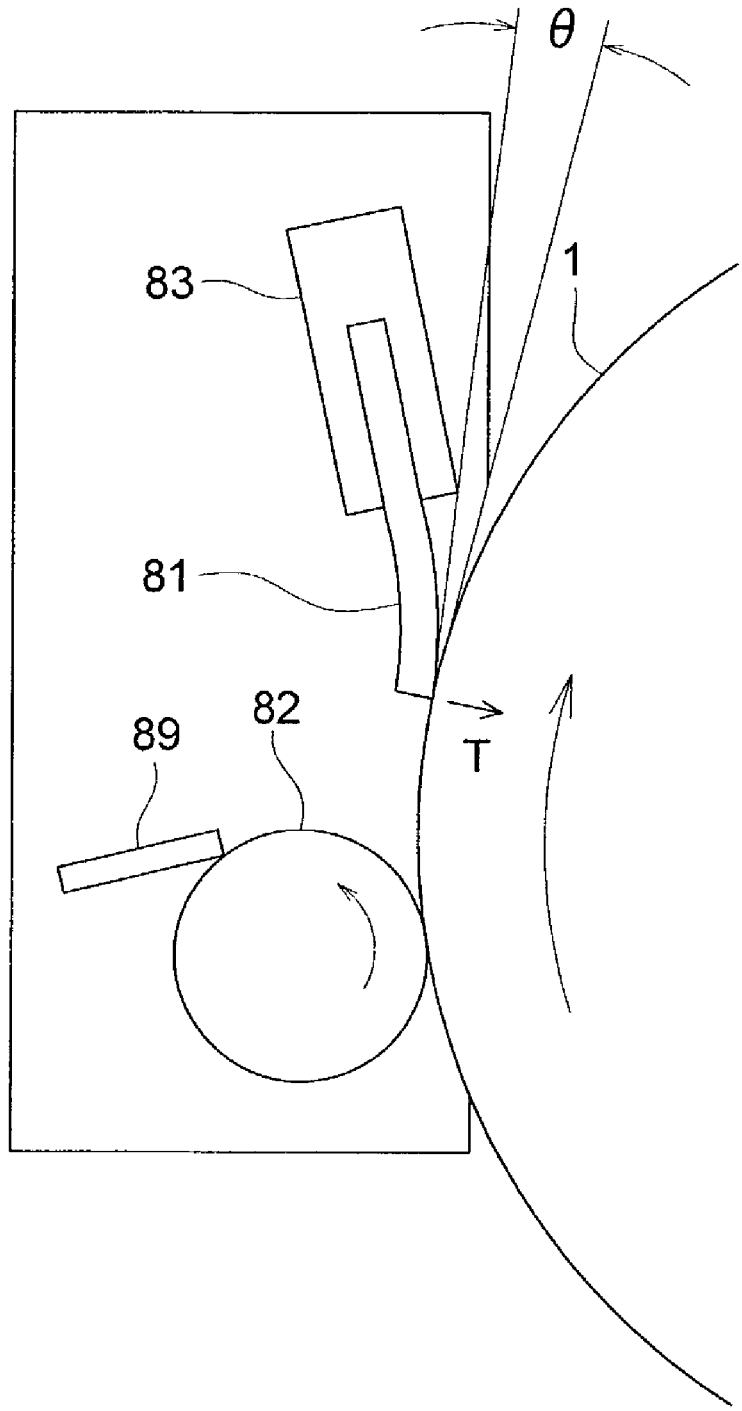
FIG. 2 is an enlarged illustration showing an embodiment of a cleaning device of the present invention.
Figure 3:
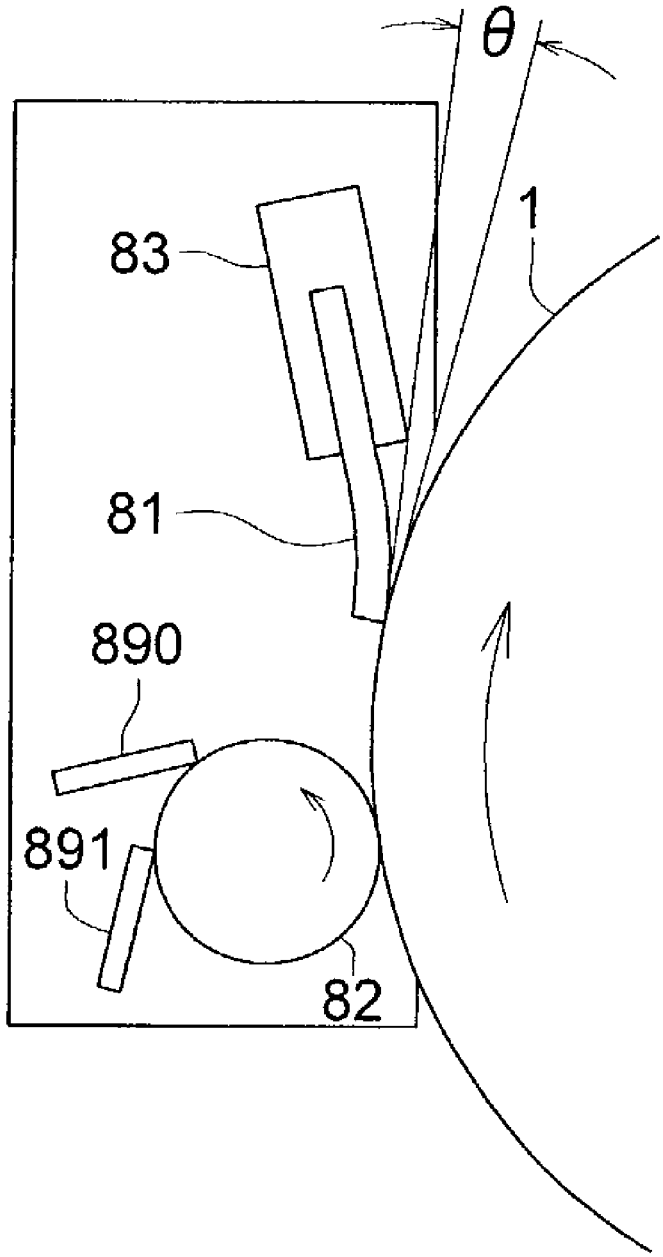
FIG. 3 is an illustration showing an example of a cleaning device provided with plural collecting members.

Numeral 8 shows a cleaning unit. On the photoreceptor 1 after the transfer, there are adhered un-transferred toner or residual toner after transfer, consequently, it is necessary to conduct cleaning of the photoreceptor 1. The cleaning unit 8 has a cleaning blade 81 consisting of a resilient blade such as urethane rubber, etc. and a cleaning roller 82. FIG. 2 shows an enlarged view of the cleaning unit 8 which is used in the image forming apparatus of the present invention. Further the present invention includes the collecting member 89 for collecting toner from the cleaning roller 82 of the cleaning unit 8. Further in the present invention, any residual toner on the photoreceptor 1 is removed by the cleaning blade 81 and the cleaning roller 82 of the cleaning unit 8, and the removed toner is provided to reuse for forming images through a recycling system shown in FIGS. 6(*a*), 6(*b*).

The present invention makes it possible to remove a small particle-sized polymerized toner, which used to be difficult for cleaning, by conducting electrical cleaning with the cleaning roller 82 to remove the majority of the residual toner on the photoreceptor, and thereafter by applying the cleaning blade 81 to remove the all other un-removed toner, which did not have the proper charge or had a charge of opposite polarity, through a transfer process.

The cleaning blade 81 is held by the fixed bade holder 83, and due to resilience of the blade, is in pressure contact with its edge against the photoreceptor 1 at almost a constant pressure. As for the blade holder 83, a type of blade holder, which is rotatable about an axis and is capable of applying a certain pressure by a spring or by a weight load, can be also used.

The weight load in the normal direction to the surface of the photoreceptor 1 (the direction indicated by T in FIG. 2) at the front edge of the cleaning blade 81 is preferably 0.1 g/cm to 30 g/cm, and more preferably is 1 g/cm to 25 g/cm.

In cases where the weight load is less than 0.1 g/cm, cleaning ability is insufficient causing imperfect cleaning, for even a small amount of toner not removed by the cleaning roller, tends to result in a smudged image. When the weight load is more than 30 g/cm, wear of the photoreceptor 1 increases, and image blur tends to occur.

For the measurement of the weight load, one method is measuring the weight value when pressing said blade on a balance to the same degree as the setting condition, or another method is electrically measuring the value of a sensor, such as a load cell, provided at the pressure contact portion between the photoreceptor 1 and the front edge of the cleaning blade 81.

Contact angle θ of the cleaning blade 81 on photoreceptor 1 is preferably 0–40°, and is more preferably 0–25°. When the contact angle θ is greater than 40°, easily caused is blade eversion which means that the tip edge of the cleaning blade 81 is reversed by following the movement of the photoreceptor. When the contact angle θ is less than 0°, cleaning force is lowered and smudged images tends to occur.

The contact angle θ is the angle formed at the contact position where the tip edge of the cleaning blade 81 touches the photoreceptor 1, measured on the downstream side of the photoreceptor 1 from the contact position.

Either of the blade holding methods of a fixed holder or a rotatable holder is applicable if the weight load and the contact angle are within the abovementioned range.

As for the material for the cleaning blade 81, a resilient material such as polyurethane rubber, etc. can be used. The rubber hardness of the cleaning blade is preferably 20–90°, more preferably is 60–80°, in JIS A hardness measured by JIS standard K-6253.

When the hardness is less than 20°, the cleaning blade is too soft and blade eversion and cleaning failure tend to occur. When greater than 90°, on the other hand, it is difficult to obtain sufficient following property to compensate for slight unevenness on the photoreceptor and for foreign substances, and tending to cause slipping-through of toner.

If the weight load and the contact angle of the cleaning blade are within the above range, there is no special limitation to the thickness of the cleaning blade 81 or to the free length of the cleaning blade 81, which is the length of the blade portion not-restricted by the blade holder 83. However, from the viewpoint of controllability of the weight load, assured cleaning ability, and preventing blade eversion, the thickness of the blade is preferably 1–3 mm, more preferably within 1.5–2.5 mm, while the free length is preferably 2–20 mm, and more preferably 3–15 mm.

The cleaning blade 81 is electro-conductive or semi electro-conductive, and has a resilient property. For performing electrical cleaning, bias voltage is applied to the cleaning roller 82 from the power supply 84. The polarity of the bias is opposite to the polarity of the toner used for development. Namely, when development is performed by a negatively charged toner and a toner image is formed by the negatively charged toner, a positive bias is applied from the power supply 84 to the cleaning roller 82.

The power supply 84 is preferably a constant current power source. By applying a constant current to the cleaning roller from the constant current power source, a potential difference is raised between the surface of the cleaning roller and the surface of the photoreceptor, causing flow of a constant current. Since the potential difference raised by the constant current is constantly generated according to the electrical potential on the photoreceptor, compared to the case of using a constant voltage power source, as described later, cleaning failure caused by an unevenness of electrical potential level or electrical polarity on the photoreceptor, is hardly generated. Further, since an extremely large potential difference is not generated, discharging on to the photoreceptor is rarely generated by applying the constant current power.

According to the present invention, due to the bias potential generated by the constant current power source between the surface of the cleaning roller and the surface of the photoreceptor, the toner is electrostatically attracted to the cleaning roller 82 and excellent cleaning effect is achieved. The applied current by the power supply 84 is changeable, being controlled by the control means 85 as described later.

Hereinafter, an excellent cleaning effect of the present invention will be explained, compared to the conventional cleaning method which applies a constant voltage.

On the surface of the photoreceptor, after the transfer, are the image area, the non-image area and the un-transferred area, therefore, the surface potential is not uniform but differs area by area. When a constant voltage is applied to the cleaning roller, the potential difference between the cleaning roller and the photoreceptor is not uniform because of the potential distribution on the photoreceptor, as mentioned above, and exhibits different values according to the image area, non-image area and not-transferred area, and the like.

For example, assuming that there are areas having surface potential V1 and V2 respectively (V1>V2), when constant voltage potential V0 is applied to the cleaning roller, the potential difference between the surface of the photoreceptor and the cleaning roller become V0−V1, and V0−V2 respectively, therefore, the electrostatic attraction force affecting the charged toner on the photoreceptor becomes un-uniform. As a result, a difference of cleaning ability arises according to the areas on the photoreceptors, causing a cleaning failure.

Comparing to the above case of applying a constant voltage, in the case of applying a constant current bias voltage to the cleaning roller, the electric field, between the surface of the photoreceptor and the surface of the cleaning roller that affects a separating force to the charged toner on the photoreceptor from the photoreceptor, is basically independent of the surface potential of the photoreceptor, and depends on the impedance of the photoreceptor observed from the cleaning roller. The impedance of the photoreceptor is not different by area, but is basically constant.

Therefore, cleaning by applying a constant current voltage to the cleaning roller exhibits a uniform cleaning effect. Namely, almost constant electrostatic attractive force can be applied to the charged toner on the photoreceptor despite differences of the surface potential of the photoreceptor. As a he result, uniform cleaning effect can be achieved to prevent a cleaning failure.

The constant current power source in the present invention means an electrical power supply apparatus constructed in such a manner that the output voltage is controlled according to the resistance between the cleaning roller and the photoreceptor to output a constant electrical current.

The current to be supplied is preferably in the range of 1–50 μA, in absolute value. When it is less than 1 μA, sufficient cleaning cannot be performed, and when it is more than 50 μA, discharging tends to be generated. The electrical current to be applied differs according to the kind of photoreceptor, the thickness of the photoreceptor, and the resistance of the cleaning roller. In cases where an organic photoconductor, with a photoconductive layer, whose thickness is 15–30 μm, formed by dispersing an organic photoconductive material in an insulative resin, and a cleaning roller whose surface resistivity is $10^2$–$10^{10}$ Ωcm are used, it is preferable to supply current raging from 5–40 μA in absolute value.

For the cleaning roller, in order to make good contact with the photoreceptor, a resilient material is used. As said resilient material, rubber materials, which have been known, such as silicone rubber, polyurethane rubber, foaming material or foaming material covered with resin are preferably used.

It is preferable that the cleaning roller is conductive or semi-conductive, and its surface electrical resistivity is $10^2$–$10^{10}$ Ωm. When the surface electrical resistance is less than 102 Ωm, banding, caused by electric discharge, tends to occur. When it is greater than $10^{10}$ Ωcm, on the other hand, potential difference that is sufficiently large to remove toner cannot be obtained, and cleaning failure tends to occur.

With respect to the cleaning roller, it is preferable that the direction of rotation of the cleaning roller is made so that the movement of the peripheral portion of the cleaning roller and the movement of the peripheral portion of the photoreceptor is in the same direction at the position where the cleaning roller is in contact with the photoreceptor. If the cleaning roller moves to the opposite direction to the photoreceptor, and when the toner on the photoreceptor is excessive, there is the tendency that toner removed by the cleaning roller is scattered to soil the transfer sheet as well as the apparatus.

Further, it is preferable that the ratio of linear speed of the cleaning roller to that of the photoreceptor is 0.5:1 to 2:1. When the ratio is out of this range, cleaning power is lowered, or cracks tend to be caused on the surface of the photoreceptor when foreign substances are caught between the cleaning roller and the photoreceptor.

The hardness of the cleaning roller is preferably 5–60°, and more preferably is 10–50°. When it is less than 5°, the roller is too soft to assure durability. When it is more than 60°, the roller is too hard to assure the necessary contact width (nip width) with the photoreceptor which is required for efficient cleaning, and in addition, scratches on the surface of the photoconductor tend to result. The hardness of the cleaning roller is the measured value of the resilient material before being formed into the roller based on JIS standard K6301.

The preferable nip width, formed where the cleaning roller contacts the photoreceptor, depends on the diameter of the roller to some extent, but a range of 0.2 to 5.0 mm is acceptable while 0.5 to 3.0 mm is preferable. When the nip width is less than 0.2 mm, cleaning ability may be insufficient, and when it is more than 5.0 mm scratches on the surface of the photoreceptor tend to appear by being scrubbed by the cleaning roller.

In the present invention, it is preferable to remove the toner and the like, which are transferred onto the cleaning roller from the photoreceptor, by contacting the collecting member 89, such as a scraper, to the cleaning roller as shown in FIG. 2. FIG. 2 shows an example of the embodiment where the scraper 89 is provided against the cleaning roller 82.

One collecting member, or two or more collecting members may be provided to contact the cleaning roller. In the embodiment of the present invention, since a bias voltage of polarity opposite to the polarity of the charged toner is applied to the cleaning roller, the adhesion force between the toner and the cleaning roller becomes so large that collecting the toner by only one collecting member may be insufficient, therefore, a plurality of collecting members is preferably provided. If the toner on the cleaning roller is not sufficiently collected, the toner on the cleaning roller may drop and soil the transfer sheet to cause soiled images. If any toner remains on the surface of the cleaning roller, in the next cycle, transfer of the toner to the cleaning roller from the photoreceptor may be insufficient, to causing cleaning failure.

As the material of the collecting member, a phosphor bronze plate, a PET resin plate, a polycarbonate resin plate and a complex of these material can be used. As for the collecting member, besides the abovementioned scraper, a roller, a fur brush, or a biased roller are possible to be used. As examples of the collecting member, FIG. 4(*a*) shows biased rollers 892 contacting the cleaning roller, while FIG. 4(*b*) shows fur brushes 893, and FIG. 4(*c*) shows a biased roller in non-contact configuration. Incidentally, the collecting member of the present invention should not be construed to be restricted to these examples.

In a cleaning system where residual toner is removed from the photoreceptor by a cleaning blade and the cleaning roller applied a bias voltage from a constant current power supply, cleaning is performed with a cleaning mechanism where the charged toner is removed electrostatically by the cleaning roller provided upstream the cleaning blade, and after that, any remaining toner, un-charged toner, toner charged at the opposite polarity, or fine particles are removed by the cleaning blade provided downstream.

By conducting the present invention, excellent cleaning effects have been achieved throughout all the stages of the image forming process, by applying to the cleaning roller a relatively small value of electrical current in the early stage of image forming process, and according to the increase of image-forming amount the value of electrical current is increased by the control means 85 in FIG. 1. As for the image-forming amount, the time consumed for image forming or the number of formed images can be applied, and the number of formed images is preferably applied.

In the early stages of the image forming process, namely, in the early period after a new cleaning blade is provided, since the cleaning ability of such newly installed cleaning blade is high, the required cleaning performance can be achieved as the whole cleaning apparatus, even if the cleaning ability of the cleaning roller is not enhanced.

Figure 5:
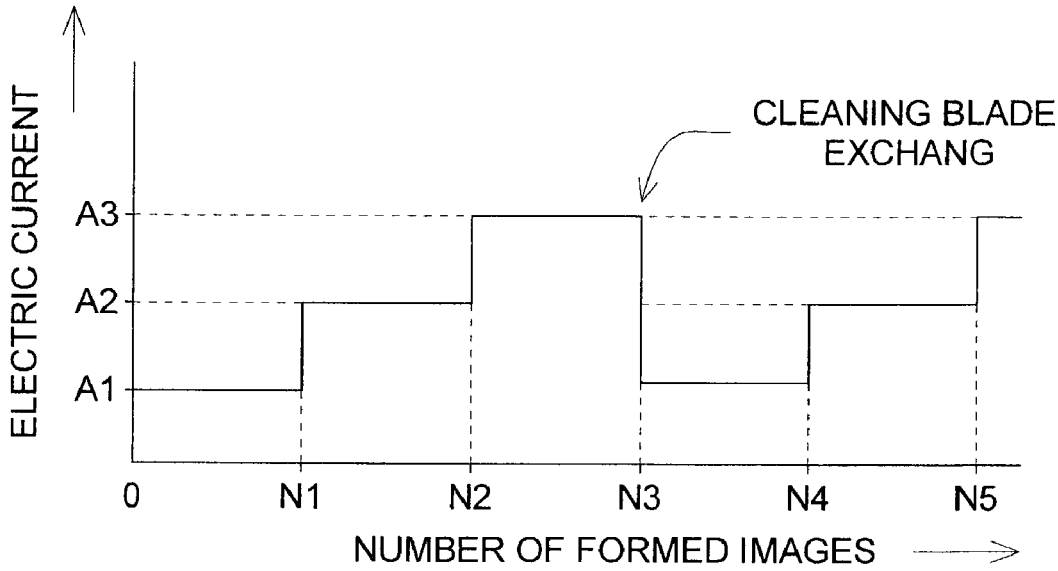
FIG. 5 is a graph showing a relation between the number of formed images and electrical bias current.

FIG. 5 shows an example of the relation between the electrical current values of the bias voltage applied to the cleaning roller and the number of formed images. As shown in the figure, according to the increase of the number of formed images from N1 to N3, the electrical current value is increased stepwise from A1 to A3, and at every time of exchanging the cleaning blade the electrical current value is reset to the initial value and is increased according to the number of formed images, and this cycle is conducted repeatedly.

According to the present invention, a high quality image can be formed even when the toner, which is un-transferred and collected from the cleaning unit, is reused. FIGS. 6(*a*) and 6(*b*) show examples of the toner recycling system applicable to the image forming apparatus of the present invention.

In FIG. 6(*a*), numeral 4 represents a developing unit, 41 represents a developer transporting sleeve, 1 represents a photoreceptor, 8 represents a cleaning unit, 16 represents a toner collecting screw, 17 and 18 represent toner transporting screws, and 20 represents a toner replenishment box. In the apparatus of the example, the toner collecting screw and two toner transporting screws transport the collected toner sequentially and supply into the exclusive recycle toner distributor 19 (separated from the supply slot for new toner) provided at the developing unit 4. The toner collecting screw 16 and the toner transporting screws 17, 18 have respectively a shaft and a blade provided on the shaft in spiral shape, and the toner is sequentially transported by the blade according with the rotation of the shaft and is supplied into the distributor 19 to be used for developing latent images on the photoreceptor 1.

In FIG. 6(*b*), numerals 4, 41, 16–18, and 20 show the same parts as shown in FIG. 6(*a*). In this embodiment, the toner collecting screw and two toner transporting screws transport the toner collected at the cleaning unit, and supply into the toner replenishment box 20. The embodiment of FIG. 6(*b*) differs from that of Fig. (a) and is characterized in that the collected toner is supplied to the developing unit 4 after blended and mixed with a new toner in the toner replenishment box 20.

In FIGS. 6(*a*) and 6(*b*), the toner remained on the photoreceptor after transfer is scraped off by the cleaning members 81 and 82 (not illustrated) in the cleaning unit, transported by the toner collecting screw 16 and the toner transporting screws 17, 18, and supplied into the developing unit 4.

Although, the toner recycling system used for the present invention is not restricted to the types shown by FIGS. 6(*a*), 6(*b*), it is preferable to use the type of toner recycling system shown by FIG. 6(*b*).

The toner recycling system used for the present invention may be the type of process cartridge, which is detachable to the image forming apparatus, or may be the type of unit unified with an image forming unit and a developing unit that is detachable to the image forming apparatus. In this case, the photoreceptor (image carrier) 1, the developing unit 4, the cleaning unit 8 and the members for the recycling system are unified to construct a process cartridge.

Further, the abovementioned image forming apparatus may be the type, in which a process cartridge including at least one of a photoreceptor drum, a charging means, a developing means and the members for recycling system, is installed.

The transfer material used in the present invention is typically a plain paper, but not especially restricted provided that developed toner images can be transferred to, and a PET sheet for OHP is naturally included, for example.

The toner to be used in the present invention will be explained as follows. The shape of the toner to be used in the present invention preferably have a value of the degree of circularity 0.930–1.000, and more preferably 0.950–0.995.

Wherein, [the degree of circularity] is defined to be equal to [the peripheral length of the circle which has the same area as the projected particle image] divided by [the peripheral length of the projected particle image]

Further, the distribution of the degree of circularity is preferably sharp. The standard of deviation of the degree of circularity is preferable to be not more than 0.10. The CV value calculated by the following equation is preferable to be less than 20% and more preferable to be less than 10%.

$$CV \text{ value} = (\text{standard variation of the degree of circularity}/\text{average degree of circularity}) \times 100$$

In the present invention, by using the toner having the degree of circularity of 0.930–1.000, effective charging parts in each toner particle become almost uniform, and charge amount distribution of the toner becomes sharp. As the result, each toner particle has almost the same level of charge amount, and an oppositely charged toner or a toner charged in extremely low level is rarely generated, therefore, toner removal by the electrical cleaning using the cleaning roller applied with a bias voltage is promoted. Wherein, the average degree of circularity is the average value obtained by measuring the degree of circularity of arbitral numbers of the toner particles.

In the toner having uniformly shaped particles, the number of charge concentrated points in each toner particle become almost same, and when the cleaning is conducted by applying a certain bias onto the cleaning roller, almost all the toner remained on the photoreceptor can be removed. Further by controlling the average degree of circularity within a specific range, since extremely irregular shaped toner particles do not exist, fine powdered toners caused by toner particle breakage due to stress by a stirrer and the like in the developing unit is prevented from being generated.

Further it is preferable to make the distribution of the degree of circularity sharp, and by making the standard deviation not more than 0.10, uniformly shaped toner can be obtained and the difference of charging amount among toner particles can be made small to eliminate a large variation in electrical adhesive forth on the photoreceptor, and this affect to promote the electrical cleaning, which is applied a bias voltage. Furthermore, by making the CV value less than 20%, sharp distribution of the degree of circularity can also be obtained, and it is preferable for conducting the electrical cleaning. The distribution of the degree of circularity being sharp means that the physical adhesive force such as van der Waals force to each toner is in the same level, and it is preferable also for the mechanical blade cleaning.

Measuring method of the above degree of circularity is not restricted to the following, but as an example, photographs of toner particle images enlarged to 2000 times by electron microscope are taken, the degree of circularity is measured by using an image analyzer for a thousand toner particles, and the arithmetic average is calculated to obtain the average degree of circularity. As for a simple measuring method, a flow type particle image analysis equipment FPIA-2000 (made by SYSMEX Corporation) can be used.

In order to control the degree of circularity, a proper process finishing time can be determined by monitoring the toner particle characteristics in the toner manufacturing process where shape of the toner is being controlled.

Monitoring means to control a process condition according to the result of measurement by incorporating a measuring apparatus into the manufacturing process line. Namely, in manufacturing the polymerized toner being used in the present invention, the measurement of toner particle shape etc. is incorporated in line, by measuring the shape and the diameter of toner particle while successively monitoring the process of association and fusion, and at the time when a required shape is observed the reaction is terminated.

In regard to a monitoring method, it is not limited in particular, and a flow type particle image analizing equipment FPIA-2000 (made by SYSMEX Corporation) can be used. This equipment is preferable because it is possible to monitor the shape by conducting image processing on a real time basis while making a sample solution to pass through. Namely, monitoring is conducted constantly from the reaction field by using a pump, while measuring a shape, and then, the reaction is stopped when the desired shape is observed.

As the toner used for the present invention, the particle size distribution rate expressed by Dv/Dp preferably satisfies the following relation;

$$1.3 > Dv/Dp > 1.0$$

and more preferably within the range of 1.1 to 1.2. Wherein, Dv represents a volume average particle diameter, and Dp represents a number average particle diameter.

In the toner whose Dv/Dp value is within the above range, toner particle size is almost even. Namely, in the toner in the above range, the effective charging area for each toner particle is almost even, and as the result of each toner particle having almost same level of charge amount, the toner of sharp charge amount distribution can be obtained. In the toner having a sharp charge amount distribution, there rarely exist toner particles charged in opposite polarity, toner particles having extremely low charge amount or toner particles excessively charged, therefore, toner removal by the electric cleaning using a biased cleaning roller is well promoted.

Further, in the toner used for the present invention, by making the rate of toner particles having no corner 50 number % or more, a preferable effect is found for preventing the generation of scratch marks on the photoreceptor and the cleaning failure, and high image quality images can be preferably obtained for a long time period.

In the case of toner used in the present invention, a toner particle having no corner means a toner particle that substantially has no protrusion where electric charges are concentrated, or no protrusion that is easily worn away by stress. Namely, under the condition that L represents a major axis of a toner particle, when a circle having radius of L/10 is made to roll along a peripheral line of the toner particle while touching at one point on the inside of the peripheral line, if the circle does not protrude out of the toner substantially, as shown in FIG. 17(*a*), the toner particle is called "toner particle having no corner". "An occasion of no protruding substantially" means the case wherein the number of protrusions where the circle protrudes out is not more than one. "A major axis of toner particle" means a width of the toner particle whose projected image makes a distance between two parallel lines, which pinch the projected image of the toner particle, to be the maximum. Incidentally, each of FIG. 17(*b*) and FIG. 17(*c*) shows a projected image of a toner particle having corners.

Measurement of toner having no corner was conducted as follows. First, a photograph of a toner particle enlarged by 2000 times was made by the use of an electron microscope of a scanning type, and it is further enlarged to obtain a photographic image enlarged by 15000 times. Then, this photographic image was measured in terms of existence of the corners. This measurement was conducted for a hundred toner particles.

In the case of toner used in the present invention, it is preferable that a rate of toner particles having no corner is 50 number % or more, and more preferable is 70 number % or more. When the rate of toner particles having no corner is 50 number % or more, it is possible to suppress isolation of additives in the developer, and to prevent damages of the photoreceptor, the cleaning roller and the cleaning blade to be caused by adhesion of the isolated additives on the surface of the photoreceptor. Further, toner particles each having a portion where electric charges are concentrated decrease, and toner particles which electrostatically isolate the additives at the cleaning roller decrease to make it possible to suppress the damage of the photoreceptor, the cleaning roller and the cleaning blade.

There is no restriction, in particular, for the method to obtain toner having no corner. For example, as a method to control the shape factor, there is available, a method to spray toner particles in a hot air current, or a method to give mechanical energy caused by impact force repeatedly to toner particles in a vapor phase, or a method to add toner in a solvent which dissolves no toner and to give circling current.

In the case of polymerization toner formed through association or fusion of resin toner, many irregularities are present on the surface of the fused particle and the surface is not smooth when the fusion is stopped, but it is possible to obtain toner particles having no corner, by making conditions such as temperature, the speed of rotation of vanes and time for stirring to be appropriate ones. Though these conditions are varied depending on physical characteristics of resin particles, the surface becomes smooth and toner particles having no corner can be formed, when the temperature higher than a glass transition point of resin particles and higher speed of rotation, for example, are selected.

In the case of toner used in the present invention, the number average particle diameter of the toner is preferably 3–9 μm, more preferably 4.5–7.5 μm and furthermore preferably 5–7 μm. When forming toner particles through a polymerization method, a particle diameter can be controlled by density of coagulant, weight of added organic solvent, or fusion time, further by composition of a polymer itself.

When the average number particle diameter is 3–9 μm, efficiency of toner transfer from the photoreceptor to the transfer sheet becomes high and image quality of halftone and image quality of fine lines and dots are improved.

In the case of toner used preferably in the present invention, when D (μm) represents a particle diameter of a toner particle, it is preferable that the sum total (M) of relative frequency (m1) included in the most frequent rank and relative frequency (m2) of toner particle included in the rank that is second highest rank to the most frequent rank is 70% or more, in the histogram showing the particle size distribution of the number basis wherein the horizontal axis is represented by natural logarithm lnD and this horizontal axis is divided into plural ranks at an interval of 0.23. When the sum total (M) of relative frequency (m1) and relative frequency (m2) is 70% or more, the extent of dispersion in particle size distribution of toner particle becomes narrow, and thereby, it is possible to restrain surely occurrence of selection development by using the aforementioned toner in the image forming process.

In the present invention, the histogram showing particle size distribution of the number basis is a histogram showing particle size distribution of the number basis wherein natural logarithm lnD (D: particle diameter of individual toner particle) is divided at interval of 0.23 into plural ranks (0–0.23: 0.23–0.46: 0.46–0.69: 0.69–0.92: 0.92–1.15: 1.15–1.38: 1.38–1.61: 1.61–1.84: 1.84–2.07: 2.07–2.30: 2.30–2.53: 2.53–2.76 . . . ), and this histogram is one prepared by particle size distribution program in the computer to which the particle diameter data of the sample measured by Coulter Multisizer under the following condition has been transferred through I/O unit.

(Measurement Condition)

(1) Aperture: 100 μm (2) Sample preparing method: An appropriate amount of surfactant (neutral detergent) is added to 50–100 ml of electrolytic solution (ISOTON R-11 (made by Coulter Scientific Japan Co.) to be stirred, and 10–20 mg of measurement sample is added to the foregoing to prepare a mixture solution. The mixture solution was subjected to dispersion processing for one minute by an ultrasonic homogenizer to prepare a sample.

Calculation of toner particle size distribution, measurement of the number average of particle diameter and volume average of particle diameter can be conducted by using Coulter Counter TA-II, Coulter Multisizer (both are made by Coulter Scientific Japan Co.) and SLAD-1100 (laser diffraction particle size measuring apparatus made by Shimadzu Corporation). In the present invention the measurement and the calculation are done by using Coulter Multisizer and the interface to output the particle size distribution (made by Nikkaki-bios Co.) and a personal computer.

In the case of toner used preferably in the present invention has the charging amount in absolute value ranging 20 to 50 μC/g. The toner having this range of charging amount is found to be effectively removed from the photoreceptor or the cleaning material. In the present invention, by applying a constant current voltage of 1–50 μA in absolute value, or a constant voltage to the cleaning roller, residual toner on the photoreceptor having the above charge amount can be surely removed and an effective cleaning effect is attained.

The method of measuring the charging amount used in the present invention for two component developer is a publicly known blow-off method which is described for example in Japanese patent Tokkai No.2001-134019.

Namely, putting the developer sample (mixture of toner and core material or carrier) into a measurement cell, in which a stainless mesh having apertures of 35 μm opening is provided in one side surface, injecting nitrogen gas from the other side surface of the cell with blow pressure of 2.0 $kg/cm^2$ for 6 seconds, and ejecting a part of toner, then the toner charging amount (Q/M) μC/g is calculated from changed charging amount in the cell (Q) and changed weight (ejected toner weight M). Here, the blow rate (rate of ejected toner) is 20–60%, namely when 1 g of toner with 5% toner concentration is put into the cell, 10–30 mg toner is ejected by the blow.

Further, in case of single component toner, a charge amount measuring apparatus consisting of a nozzle to suck in the toner, a filter to catch the toner and an electrometer is used as described for example in Tokkaihei No. 11-271371.

Hereinafter, manufacturing method of the toner used for the present invention will be explained. Toner used in the present invention can be manufactured by, for example, a suspension polymerization method, or a method wherein a monomer is subjected to emulsion polymerization in a solution containing necessary additives to make fine grains of polymer particles, then, an organic solvent and a coagulating agent are added thereto to be associated. It is further possible to manufacture by a method wherein there are mixed a monomer and a dispersed solution of releasing agents and coloring agents both necessary for constituting toner, or a method wherein toner constituent components such as releasing agents and coloring agents are dispersed in a monomer and then they are subjected to emulsion polymerization. In this case, "association" means that a plurality of resin particles and a plurality of coloring agent particles are fused.

Incidentally, an aqueous medium mentioned in the present invention is one containing at least 50% by weight of water.

In an example of the method for manufacturing toner, various constituent materials such as a coloring agent and further, if necessary, a releasing agent, a charge controlling agent and a polymerization starting agent are added to a solvent of polymerizable monomer, and the various constituent materials are dissolved or dispersed in the solvent of polymerizable monomer by a homogenizer, a sand mill, a sand grinder or an ultrasonic homogenizer. The solvent of polymerizable monomer in which the various constituent materials are dissolved or dispersed is dispersed in an aqueous medium containing dispersion stabilizing agents by the use of a homo-mixer or a homogenizer, to obtain a dispersion solution containing an oil droplet having a desired size as toner. After that, the dispersion solution is put in a reaction vessel wherein a stirring mechanism is represented by a stirring blade stated later, to be heated so that polymerization reaction is advanced. After completion of the reaction, the dispersion stabilizing agents are removed, and the dispersion solution is filtered, washed and dried, to prepare toner.

Further, as a method to manufacture toner, there is given a method wherein resin particles are subjected to association or fusion in aqueous medium to manufacture toner. This method is not limited in particular, and is disclosed in, for example, Tokkaihei Nos. 5-265252, 6-329947 and 9-15904.

Namely, it is possible to manufacture toner in a method wherein a plurality of resin particles and dispersion particles of constituent materials such as coloring agents are subjected to association, and in particular, it is possible to manufacture toner by adding coagulant having critical coagulation density or higher for salting-out after dispersing in water by using an emulsifier, by heating for fusion at a glass transition point of the formed polymer itself so that fused particles may be formed while growing gradually in terms of a particle diameter, by stopping growth of the particle diameter by adding a large amount of water when the particle diameter shows the aimed value, by controlling a shape by smoothing the particle surface while heating and stirring further, and by heating and drying the particles under the flowing condition while they are in the state of containing water. Incidentally, a solvent that dissolves infinitely in water may also be added simultaneously with coagulant.

Those used as polymerizable monomers constituting resins include styrene or styrene derivatives such as, o-methylstyrene, m-methylstyrene, o-methylstyrene, α-methylstyrene, p-chlorostyrene, 3,4-dichlorostyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene, and p-n-dodecylstyrene; methacrylic acid ester derivatives such as methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, diethyl aminoethyl methacrylate, and dimethyl aminoethyl methacrylate;

acrylate derivatives such as methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate, phenyl acrylate, and the like;

olefins such as ethylene, propylene, isobutylene, and the like, halogenated vinyls such as vinyl chloride, vinylidene chloride, vinyl bromide, vinyl fluoride, vinylidene fluoride, and the like, and vinyl esters such as vinyl propionate, vinyl acetate, vinyl benzoate, and the like;

vinyl ethers such as vinyl methyl ether, vinyl ethyl ether, and the like;

vinyl ketones such as vinyl methyl ketone, vinyl ethyl ketone, vinyl hexyl ketone, and the like;

N-vinyl compounds such as N-vinylcarbazole, N-vinylindole, N-vinylpyrrolidone, and the like;

vinyl compounds such as vinylnaphthalene, vinylpyridine, and the like;

acrylic acid or methacrylic acid derivatives such as acrylonitrile, methacrylonitrile, acrylamide, and the like;

These vinyl monomers can be used either independently or in combination.

Further, it is more preferable that those having ionic dissociation groups as polymerizable monomers constituting resins are used in combination. Examples thereof are those each having a substituent such as carboxyl group, sulfonic acid group and phosphoric acid group as a constituting group of a monomer, and there are concretely given acrylic acid, methacrylic acid, maleic acid, itaconic acid, cinnamic acid, fumaric acid, monoalkyl maleate, monoalkyl itaconate, styrenesulfonic acid, allylsulfosuccinic acid, 2-acrylamido-2-methylpropanesulfonic acid, acidphosphoxyethyl methacrylate, 3-chloro-2-acidphosphoxypropyl methacrylate.

It is further possible to make resins of a cross linkage structure by using polyfunctional vinyls such as divinylbenzene, ethylene glycol dimethacrylate, ethylene glycol diacrylate, diethylene glycol dimethacrylate, diethylene glycol diacrylate, triethylene glycol dimethacrylate, triethylene glycol diacrylate, neopentyl glycol methacrylate, neopentyl glycol diacrylate, and the like.

These polymerizable monomers can be polymerized by using radial polymerization starting agents. In this case, oil-soluble polymeriztion starting agents can be used for the suspendion polymerization method. As this oil-soluble polymeriztion starting agent, there are given azo or diazo polymerization starting agents such as 2,2'-azobis-(2,4-dimethylvaleronitrile), 2,2'-azobisisobutyronitrile, 1,1'-azobis (cyclohexane-1-carbonitrile, 2,2'-azobis-4-methoxy-2,4-dimethylvaleronitrile, azobisisobutyronitrile; and peroxide polymerization starting agent such as benzoyl peroxide, methyl ethyl ketone peroxide, diisopropyl peroxycarbonate, cumene hydroperoxide, t-butyl hydroperoxide, di-t-butyl peroxide, dicumyl peroxide, 2,4-dichlorobenzoyl peroxide, lauroyl peroxide, 2,2-bis-(4,4-t-butylperoxydichlorohexyl) propane, tris-(t-butylperoxy)triazine, or high polymer starting agent having peroxide on the side chain.

Further, when using an emulsion polymerization method, a water-soluble radical polymerization starting agent can be used. As a water-soluble polymerization starting agent, there are given persulfate such as potassium persulfate and ammonium persulfate, azobisamino dipropane acetate, azobiscyano valeric acid and its salt and hydrogen peroxide.

As a dispersion stabilizing agent, there are given tricalcium phosphate, magnesium phosphate, zinc phosphate, aluminum phosphate, calcium carbonate, magnesium carbonate, calcium hydroxide, magnesium hydroxide, aluminum hydroxide, calcium metasilicate, calcium sulfate, barium sulfate, bentonite, silica, alumina.

Further, as a dispersion stabilizing agent, it is possible to use one used generally as a surfactant such as polyvinyl alcohol, gelatin, methylcellulose, sodium dodecylbenzenesulfonate, ethylene oxide Further, when using an emulsion polymerization method, a water-soluble radical polymerization starting agent can be used. As a water-soluble polymerization starting agent, there are given persulfate such as potassium persulfate and ammonium persulfate, azobisamino dipropane acetate, azobiscyano valeric acid and its salt and hydrogen peroxide.

As the resin used in the present invention, resin whose glass transition point is 20–90° C. is preferable, and resin whose softening point is 80–220° C. is preferable.

The glass transition point is one to be measured by differential thermal analysis method, while the softening point can be measured by Capillary Rheometer Shimazu Flowmeter. Further, as these resins, the resin whose molecular weight measured by a gel permeation chromatography is 1,000–100,000 in terms of number average molecular weight (Mn), and is 2,000–1,000,000 in terms of weight average molecular weight (Mw) is preferable. Further, as molecular weight distribution, the one having Mw/Mn of 1.5–100 is preferable and the one having Mw/Mn of 1.8–70 is especially preferable.

Though coagulants used in association of the resin particles in aqueous medium are not limited in particular, those selected from metal salt are used preferably. To be concrete, there are given a salt of an alkali metal such as, for example, sodium, potassium and lithium as a monovalent metal, a metal salt of alkaline earths such as, for example, calcium and magnesium, as a divalent metal, a salt of divalent metal such as manganese and copper, and a salt of trivalent metal such as iron and aluminum. As a concrete salt, there are given sodium chloride, potassium chloride, lithium chloride, calcium chloride, zinc chloride, copper sulfate, magnesium sulfate, and manganese sulfate. These may also be used in combination.

It is preferable that the coagulants stated above are added to exceed the critical coagulation density. This critical coagulation density is an index relating to stability of water dispersion, and it shows density at which the coagulation is generated after coagulants are added. This critical coagulation density varies greatly depending on the emulsified components and dispersing agents themselves. For example, it is described in "High Polymer Chemistry 17,601 (1960) compiled by Institute of High Polymer" written by Seizo Okamura and others, and detailed critical coagulation density can be obtained. Further, in another method, a desired salt is added to a particle dispersed solution targeted by changing density, then, ζ voltage of its dispersed solution is measured, and salt density at which the measured value changes can also be obtained as critical coagulation density.

With regard to an amount of added coagulants in the present invention, the amount corresponding to the critical coagulation density or higher is acceptable, but the preferable amount is one corresponding to the density which is not less than 1.2 times the critical coagulation density, and the more preferable is one corresponding to the density which is not less than 1.5 times the critical coagulation density.

"A solvent that dissolves infinitely in water" means a solvent that dissolves infinitely in water, and for this solvent, there is selected one in which the resin formed is not dissolved in the present invention. In concrete terms, there may be given alcohols such as methanol, ethanol, propanol, isopropanol, t-butanol, methoxy ethanol and butoxy ethanol, nitryl such as acetonitrile and ether such as dioxane. In particular, ethanol, propanol and isopropanol are preferable.

It is preferable that an amount of the solvent dissolving infinitely is 1–100% by volume of a polymer containing dispersed solution to which coagulants have been added.

Incidentally, for uniformizing a shape, colored particles are prepared, then, after filtration, slurry wherein water of not less than 10% by weight of particles is contained is preferably subjected to fluid drying, and in this case, the one having a polarity group in a polymer is especially preferable. The reason for that is as follows; water existing exhibits an effect to swell to some extent for the polymer having therein a polarity group, and thereby, a shape is easily uniformized in particular.

Toner used in the present invention contains at least resins and coloring agents, and in case of need, it may also contain releasing agents representing fixing property improving agents or charging controlling agents. Further, it may also be one wherein external additives composed of inorganic fine particles and organic fine particles are added to toner particles containing therein the aforementioned resins and coloring agents as main components.

As coloring agents used for toner that is used in the present invention, carbon black, magnetic substances, dyes and pigments can be used voluntarily, and as carbon black, there are used channel black, furnace black, acetylene black, thermal black and lamp black. As magnetic substances, there may be used ferromagnetic metal such as nickel and cobalt, alloys containing these metals, compounds of ferromagnetic metal such as ferrite and magnetite, alloys containing no ferromagnetic metal but showing ferromagnetism after being subjected to heat treatment, for example, alloys of the kind called Heusler's alloy such as manganese-copper-aluminum and manganese-copper-tin, and chromium dioxide.

As dyes, it is possible to use C. I. solvent reds 1, 49, 52, 58, 63, 111 and 122, C. I. solvent yellows 19, 44, 77, 79, 81, 82, 93, 98, 103, 104, 112 and 162, and C. I. solvent blues 25, 36, 60, 70, 93 and 95, and further, mixtures of the foregoing may also be used. As pigments, it is possible to use C. I. pigment reds 5, 48:1, 53:1, 57:1, 122, 139, 144, 149, 166, 177, 178 and 222, C. I. pigment oranges 31 and 43, C. I. pigment yellows 14, 17, 93, 94 and 138, C. I. pigment green 7 and C. I. pigment blues 15:3 and 60, and further, mixtures of the foregoing may also be used. Number average primary particle diameters are various depending on types, and what is preferable is about 10–200 nm.

As a method of adding coloring agents, it is possible to use a method wherein coloring agents are added to color a polymer in the step to coagulate polymer particles prepared by an emulsion polymerization method by adding coagulants, and a method wherein coloring agents are added in the step to polymerize monomers for polymerization and preparation of colored particles. Incidentally, when adding coloring agents in the step to prepare polymers, it is preferable to use the coloring agents after treating the surface with coupling agents so that radical polymerization may not be inhibited.

Further, low molecular weight polypropylene (number average molecular weight=1500–9000) serving as fixing property improving agents and low molecular weight polyethylene may be added.

Further, various charging controlling agents which are known and are capable of being dispersed in water can be used. To be concrete, there are given nigrosine dyes, metal salt of naphthenic acid or of higher fatty acid, alkoxyl amine, a quaternary ammonium salt compound, azo metal comples and metal salt salicylate or its metal complex.

Incidentally, with respect to particles of charging controlling agents and fixing property improving agents, it is preferable that the number average primary particle diameter under the dispersed state is made to be about 10–500 nm.

In the case of toner by a suspension polymerization method wherein toner is obtained through suspension of polymerizable monomer in which toner constituent components such as coloring agents are dispersed or dissolved in the water medium and through polymerization, it is possible to control a shape of toner by controlling a flow of medium in a reaction vessel in which polymerization reaction is carried out. Namely, when forming a large number of toner particles having a shape with a shape factor of 0.930–1.000, a flow of medium in the reaction vessel is made to be a turbulent flow, and at the point of time when oil droplets existing in water medium under the state of suspension change gradually into macromolecule after progress of polymerization and they turn out to be soft particles, particles are made to collide to accelerate association, and thus, particles having irregular shapes are obtained. When forming spherical toner particles whose shape factor is 1.000, a flow of the medium in the reaction vessel is made to be a laminar flow, and collision of particles is avoided, thus, spherical particles are obtained. In this method, distribution of toner shapes can be controlled to be within a range of the present invention.

Figure 7:
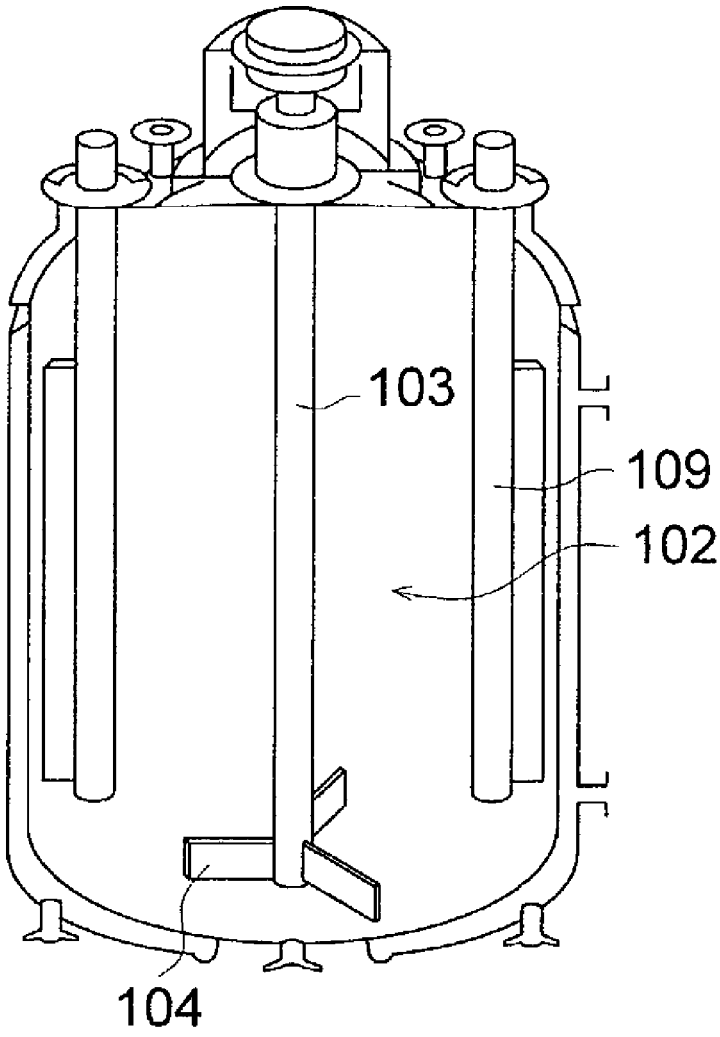
FIG. 7 is a perspective view showing an example of a conventional reactor vessel equipped with agitator vanes, which is used for manufacturing toner.

In the polymerization method, it is possible to form a turbulent flow by using a specific stirring blade, and to control a shape easily. Though the reason for this is not clear, when the structure of stirring blade 104 attached to rotating axis 103 is of one step as shown in FIG. 7, a flow of medium formed in stirring tank 102 becomes only a flow moving along the wall surface from the lower portion to the upper portion of the stirring tank 102. In the past, therefore, turbulent flow forming member on the wall face of the stirring tank 102 has been arranged in general to form a turbulent flow and to increase efficiency of stirring. In such structure of apparatus, however, existence of the turbulent flow makes a flow of the medium to stagnate, resulting in less shear stress for the particles, which makes it impossible to control shapes.

A reaction apparatus equipped with a stirring blade that can be used preferably in a polymerization method will be explained, referring to the drawings.

Figure 8:
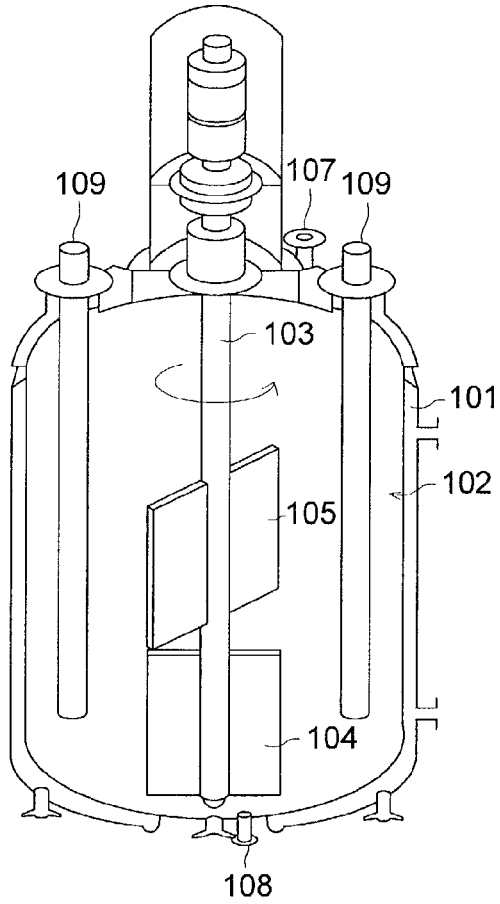
FIG. 8 is a perspective view showing an example of a reactor vessel equipped with agitator vanes, which is used for manufacturing toner of the present invention.
Figure 9:
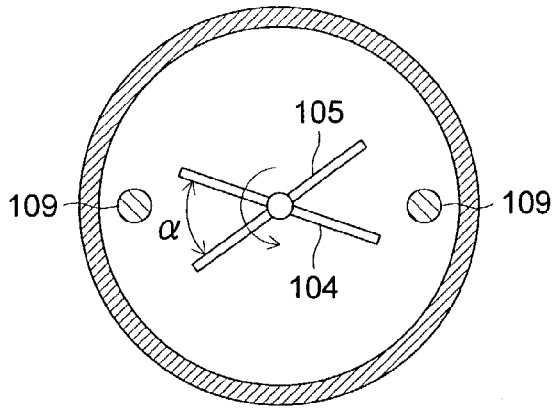
FIG. 9 is a sectional plan view of the reactor vessel shown in FIG. 8.

FIG. 8 is a perspective view showing an example of the reaction apparatus having stirring blades. The rotary shaft 103 is arranged vertically at the central portion of cylindrical stirring tank 102 of a vertical type equipped with jacket 101 for heat exchanging, and lower stirring blade 104 arranged to be near the bottom surface of the stirring tank 102 and stirring blade 105 arranged to be higher than the stirring blade 104 are provided on the rotary shaft 103. The upper stirring blade 105 is arranged to be ahead of the stirring blade 104 positioned at a lower step by crossed axes angle $\alpha$ in the direction of rotation. In the course of manufacturing toner of the present invention, crossed axes angle $\alpha$, which is less than 90°, is preferable. Though the lower limit of the crossed axes angle $\alpha$ is not limited in particular, 5° or more is preferable, and more preferable is 10° or more. FIG. 9 is the sectional view of this stirring tank. When providing three-stepped stirring blades, a crossed axes angle between adjoining stirring blades, which is less than 90° is preferable.

By employing the structure of this kind, the medium is stirred first by the stirring blade arranged on the upper step, and a flow toward the lower side is formed. Then, the flow formed by the upper stirring blade is accelerated downward by the stirring blade arranged on the lower step, and another flow toward the lower portion is formed by the lower stirring blade itself, thus, it is assumed that the total flow is accelerated to be advanced. As a result, it is assumed that a flow area having great shear stress formed as a turbulent flow is formed, and thereby, shapes of toner particles obtained can be controlled.

Incidentally, in FIG. 8 and FIG. 9, an arrow shows the direction of rotation, the numeral 107 represents an upper material inlet, 108 represents a lower material inlet and 109 represents a turbulent flow forming member for making stirring to be effective.

Though shapes of stirring blades are not restricted in particular, in this case, there may be used a square and flat blade, a blade having a cut-out on a part of the blade and a blade having one or more holes, namely, the so-called slits on the central portion of the blade. These concrete examples are described in FIGS. 10(*a*)–10(*d*). Stirring blade 105*a* shown in FIG. 10(*a*) is one having no inner hole section, stirring blade 105*b* shown in FIG. 10(*b*) is one having big inner hole section 106*b* at the central portion, stirring blade 105*c* shown in FIG. 10(*c*) is one having horizontal inner hole sections 106*c* (slits) and stirring blade 105*d* shown in FIG. 10(*d*) is one having vertical inner hole sections 106*d* (slits). An inner hole section (106*b*–106*d*) formed on the upper stirring blade and that formed on the lower stirring blade may be either different each other or the same.

Figure 11:
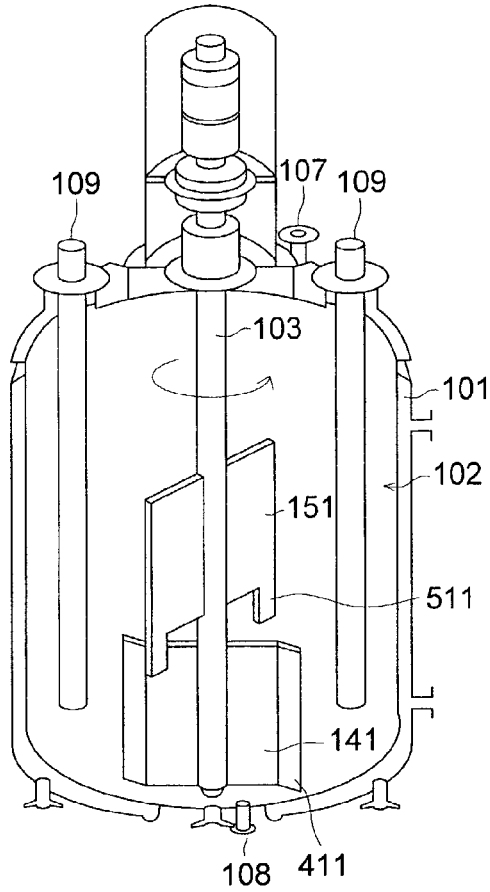
FIG. 11 is a perspective view showing an example of a reactor vessel equipped with agitator vanes, which can be used in the present invention.
Figure 12:
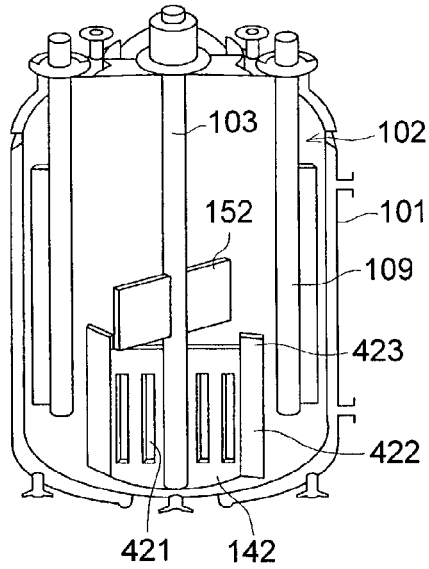
FIG. 12 is a perspective view showing an example of a reactor vessel equipped with agitator vanes, which can be used in the present invention.
Figure 13:
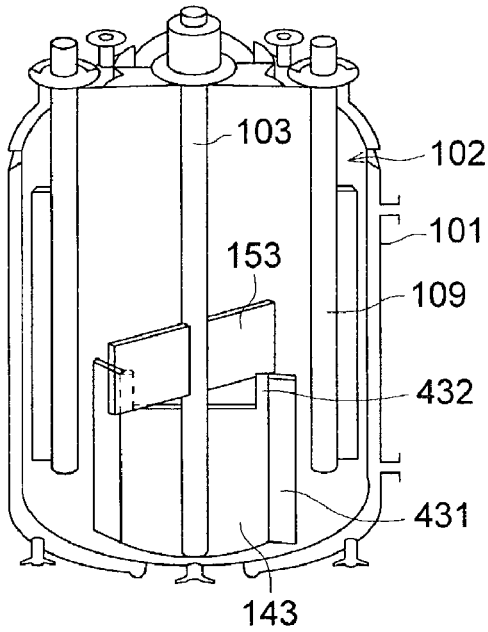
FIG. 13 is a perspective view showing an example of a reactor vessel equipped with agitator vanes, which can be used in the present invention.
Figure 14:
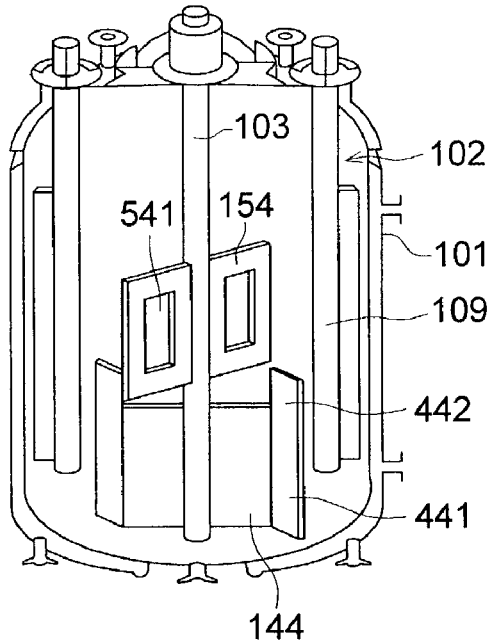
FIG. 14 is a perspective view showing an example of a reactor vessel equipped with agitator vanes, which can be used in the present invention.
Figure 15:
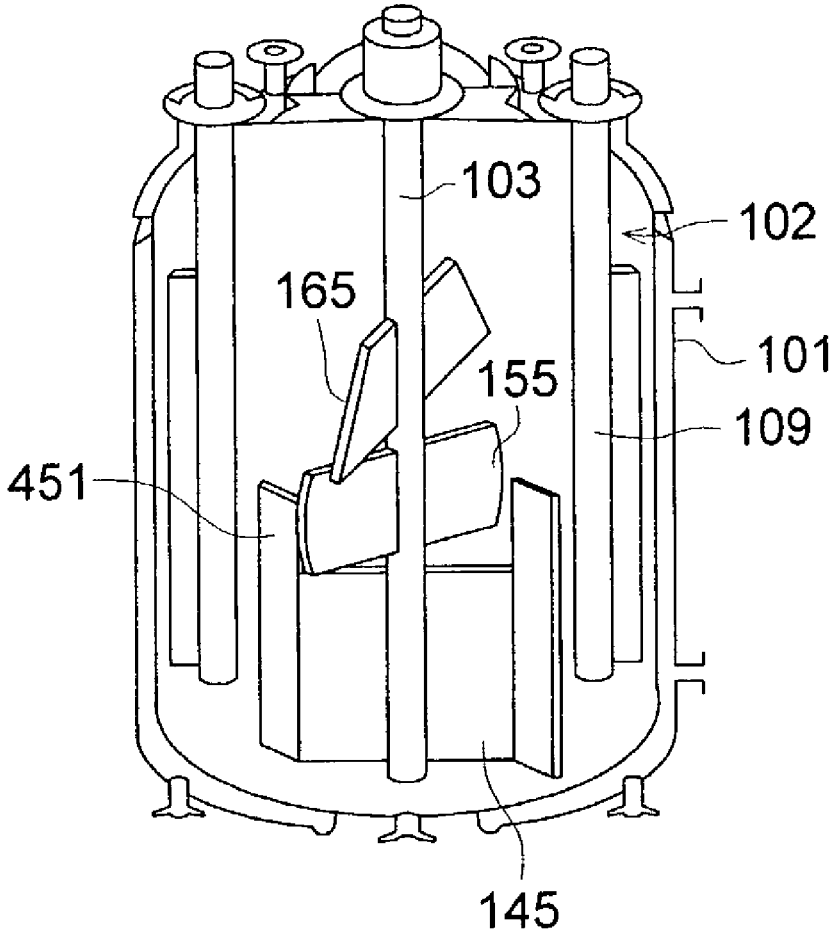
FIG. 15 is a perspective view showing an example of a reactor vessel equipped with agitator vanes, which can be used in the present invention.

Each of FIG. 11–FIG. 15 is a perspective view showing a concrete example of a reaction apparatus equipped with a stirring blade which can be used preferably. FIG. 11 shows a structure having fin (protrusion) 511 and/or a bent portion 411 formed on the edge of the stirring blade. FIG. 12 shows a structure having slits and a bent portion on the lower stirring blade 142. FIG. 13 shows a structure having fin 432 and bent portion 431 at the edge of lower stirring blade 143. FIG. 14 shows a structure having a hole 541 in upper stirring blade 154, and bent portion 441 and fin 442 on lower stirring blade 144. FIG. 15 shows a structure having three step stirring blades. Incidentally angle of the bent portion on the edge of the stirring blade is preferably 5–45°.

The stirring blade having the structure including the bent portion and the protrusion (fin) projecting upward or downward mentioned above is one for generating a turbulent flow effectively.

Incidentally, a clearance between the stirring blade on the upper step and that on the lower step in the aforesaid structure is not restricted in particular, but it is preferable that at least a clearance is present between blades. The reason for this is not clear, but it is considered that the stirring efficiency is improved because a flow of medium is formed through the clearance. However, the clearance is the same in terms of dimension as a width that is 0.5%–50%, preferably 1%–30% of a height of a liquid level in the state of standing.

Further, the sum total of heights for all blades is 50%–100%, preferably 60%–95% of a height of a liquid level in the state of standing, though a size of the stirring blade is not limited in particular.

Figure 16:
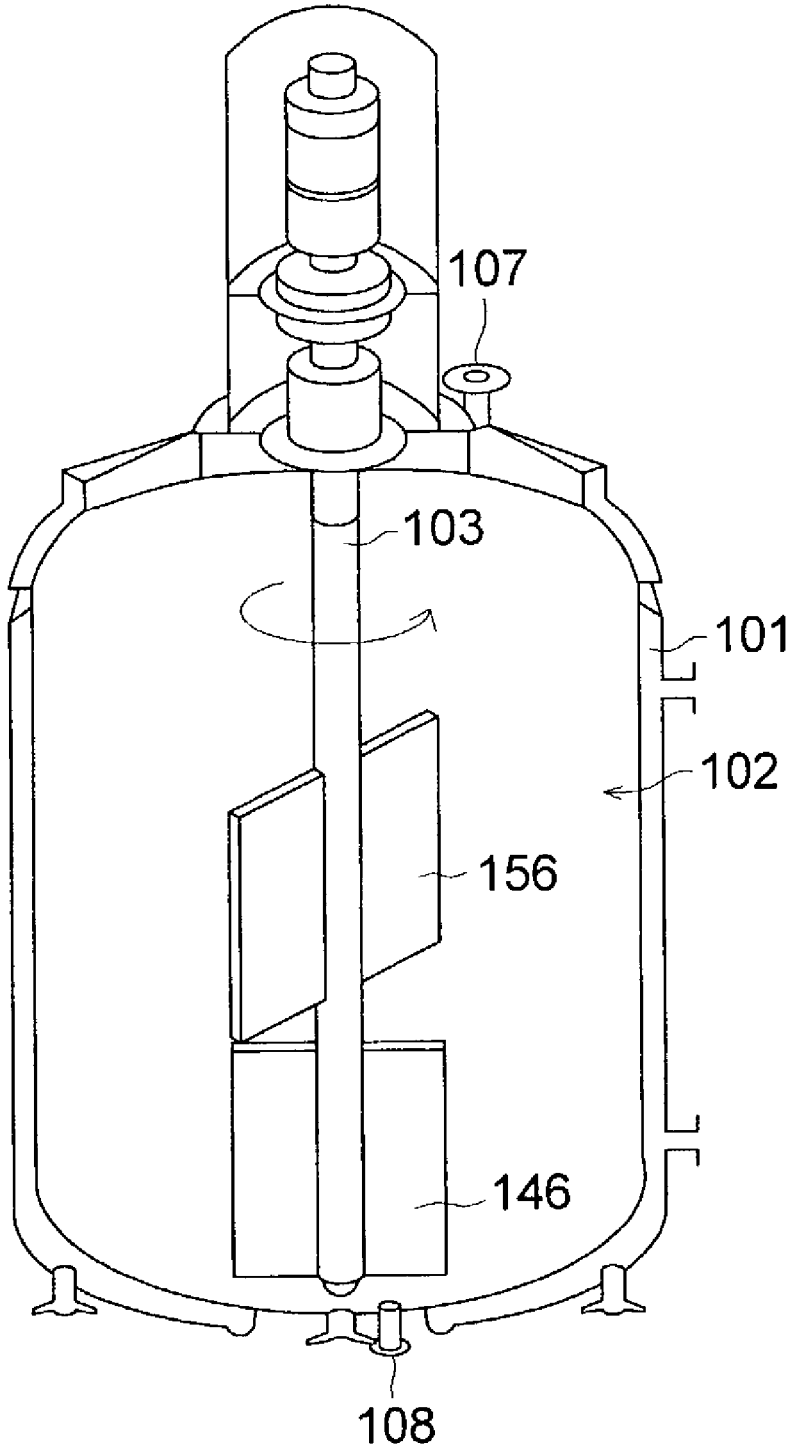
FIG. 16 is a perspective view showing an example of a reactor vessel equipped with agitator, which can be used in the present invention.

FIG. 16 shows an example of a reaction apparatus that is used when forming a laminar flow in a suspension polymerization method. This reaction apparatus is characterized in that a turbulent flow forming member (an obstacle such as an interrupting plate) is not provided. In regard to the preferable structure of the stirring blade, same as the case to form the abovementioned turbulence, constituted of multi steps of stirring blades, and the upper stirring blade 156 has crossed axes angle of α to the lower stirring blade 146.

The form of a stirring blade constituting the reaction apparatus mentioned above is not restricted in particular provided that a turbulent flow is not formed, but the one formed by a continuous surface such as a square and flat one shown in FIG. 10(*a*) is preferable, and it may have a curved surface.

On the other hand, in the case of toner by polymerization method wherein resin particles are subjected to association or fusion in water medium, it is possible to change optionally a form distribution and forms for the whole toner, by controlling a flow and temperature distribution in the reaction vessel at the step of fusion, or further by controlling the heating temperature, the number of revolutions for stirring and a period of time in the shape controlling step after fusion.

In the case of toner by polymerization method wherein resin particles are subjected to association or fusion, it is possible to form toner having a targeted shape factor and a uniform shape distribution, by using a stirring blade and a stirring tank which can make a flow in the reaction apparatus to be a laminar flow and can uniformize inner temperature distribution, and by controlling a fusion process and a temperature, the number of revolutions and a period of time in the fusion process. The assumed reason for the foregoing is as follows; when the field where a laminar flow has been formed is magnetized, intensive stress is not applied on particles (associated or coagulated particles) on which coagulation and fusion have been advanced, and temperature distribution in the stirring tank is uniform in the laminar flow wherein a flow has been accelerated, and thereby, the shape distribution of fused particles becomes to be uniform. Further, the fused particles are changed into spheres gradually by heating and stirring in the form controlling step thereafter, thus, a form of a toner particle can be controlled optionally.

As a stirring blade and a stirring tank used in the course of manufacturing toner by polymerization method wherein resin particles are subjected to association or fusion, it is possible to use ones which are the same as those in the case of forming a laminar flow in the above-mentioned suspension polymerization method, and for example, any one shown in FIG. 8-15 can be used. It is characteristic that an obstacle such as an interrupting plate causing a turbulent flow is not provided in the stirring tank. With regard to the structure of the stirring blade, it is preferable to employ a multi-step structure shown in FIG. 9 wherein a stirring blade on the upper step is arranged to be ahead of a stirring blade on the lower step by crossed axes angle α in the direction of rotation, which is the same as the stirring blade used in the aforesaid suspension polymerization method.

With regard to a form of a stirring blade, it is possible to use one which is the same as that in the case of forming a laminar flow in the suspension polymerization method, and it is not restricted in particular provided that a turbulent flow is not formed, but the one formed by a continuous surface such as a square and flat one (shown in FIG. 10(*a*)) is preferable, and it may have a curved surface.

In the case of toner used in the present invention, it is possible to improve toner characteristics further by using fine particles such as inorganic or organic fine particles, as external additives.

As this inorganic fine particle, the use of particles of inorganic oxide such as silica, titania and alumina is preferable, and further, it is preferable that these inorganic fine particles have been hydrophobic-processed by silane coupling agents or titanium coupling agents. As an extent of hydrophobic processing, it is not limited in particular, but the one with methanol wetability of 40–95 is preferable. The methanol wetability is one to evaluate wettability for methanol. In this method, 0.2 g of inorganic fine particles to be measured is measured and added to 50 ml of distilled water in a beaker with capacity of 200 ml. Methanol is dropped slowly, under the state of slow stirring, from a buret whose tip is dipped in a liquid, until the whole of inorganic fine particles are wetted. When "a" (m1) represents an amount of methanol needed to wet the inorganic fine particles completely, a degree of hydrophobicity is calculated by the following expression.

$$\text{Degree of hydrophobicity}=(a/(a+50))\times 100$$

An amount of the external additives to be added is 0.1–5.0% by weight in toner, and it preferably is 0.5–4.0% by weight. Various external additives may also be used in combination.

The toner used in the present invention may be applied as single component developer or two-component developer. As the single component developer, there are non-magnetic single component developer and magnetic single component developer containing magnetic particles of 0.1–0.5 μm, and either of these can be used.

The toner can be used as two-component developer by mixing with carrier. In this case, as magnetic particle of the carrier, metal such as iron, ferrite, magnetite or alloy of these metal and other metal such as aluminum and lead can be used, and ferrite is especially preferable. The volume average diameter of the above magnetic particle is preferably 15–100 μm, and more preferably is 25–80 μm.

The volume average diameter of the carrier can be measured representatively by laser diffraction particle size distribution measuring apparatus "HELOS" (made by SYMPATEC Co.).

As the carrier, the coated carrier in which magnetic particles are coated with resin or the resin dispersed type carrier in which magnetic particles are dispersed in resin is preferable. The coating resin is not specially restricted, but for example, olefin resin, styrene resin, styrene-acryl resin, silicone resin, ester resin or fluorine containing polymer can be used. As the resin constituting resin dispersed type carrier, especially not restricted but publicly known resin such as styrene-acryl resin, polyester resin, fluorine resin or phenol resin can be used.

The exposure unit in the abovementioned image forming apparatus shown in FIG. 1 may be a unit used for forming an electrostatic latent image on the photoreceptor by exposing a beam modulated with digital image data from a computer.

In the image forming apparatus applied with a digital system, improvement of image quality, conversion and editing etc. are easy to be performed, and high quality image formmation is possible. As the scanning optical system, which is applied in the image forming apparatus, for modulating light beam by the digital image signal from a computer or a copying original, there are an apparatus which modulates a light beam with an acousto-optical modulator incorporated in a laser optical system, and an apparatus which directly modulates a laser intensity with the use of laser diode. With these scanning optical system, a uniformly charged photoreceptor is exposed to spot light to form a dot image.

The beam exposed from the abovementioned scanning optical system has a circular or an oval luminance distribution, which is approximately in normal distribution with expanded skirt portion. For example the laser beam spot on the photoreceptor is circler or oval and has very small width in primary scanning direction and/or in sub-scanning direction of 20–100 μm.

As the photoreceptor used for the image forming apparatus of the present invention, concretely cited are, an inorganic photoconductor such as a selenium photoconductor and an arsenic selenium photoconductor, an amorphous silicone photoconductor and an organic photoconductor, however from the viewpoints of cost and environmental issue, an organic photoconductor is especially useful. An organic photoconductor is typically structured by dispersing organic photoconductive material in a resin, wherein organic compound has a function of charge generation and/or charge transportation In the conventional technology, the surface of organic photoconductor is relatively low strength, and it is difficult to apply strong cleaning force. When the contact pressure of a cleaning blade, which is widely used as a cleaning means, is made too high, the surface of the organic photoconductor tends to be worn away, therefore the contact pressure is set relatively in low level. This makes it difficult to keep stable cleaning performance for a long period.

However, by applying the abovementioned cleaning of the present invention, even without increasing the contact pressure of the cleaning blade, good cleaning performance can be obtained, and even when an organic photoconductor is used for the photoreceptor, the abovementioned problem of the conventional cleaning is eliminated.

As a favorable fixing method for the image forming apparatus of the present invention, there is a contact heating method. Especially in the contact heating method, can be cited a heat pressure fixing method, heat roller fixing method, and further, pressure contact heat fixing method wherein a rotatable pressure material is equipped a fixedly provided heater.

In the heat roller fixing method, a fixing unit in many cases is constructed with an upper roller made by iron or aluminum cylinder whose surface is coated with tetrafluoroetylene or polytetrafluoroetylene-perfluoroalkoxyvinylether copolymer etc. and is provided a heater in the cylinder, and a lower roller formed with silicone rubber etc. In a typical example, a line heater is provided as a heat source and the temperature on the surface of the upper roller is kept about 120–200° C. At the fixing section, a pressure is applied to the upper roller and the lower roller to deform the lower roller and to form a nip. The nip width is 1–10 mm, and preferably is 1.5–7 mm. The line speed for fixing is preferably 40–600 mm/sec. When the nip width is too small, uniform heat transfer to toner becomes difficult, and results in uneven fixing. On the other hand, when the nip width is too large, melting of the toner resin is urged and results in excessive fixing offset problem.

A fixing cleaning mechanism can be provided to a fixing unit. A method of supplying silicone oil to the upper fixing roller or a method of cleaning the upper roller with a pad, roller, or web impregnated with silicone oil can be used.

The embodiment of the present invention will be explained in the following paragraphs, the present invention naturally is not construed to be restricted to the embodiment.

(1) Experimental Condition

As the embodiment of the present invention, the image forming apparatus shown in FIG. 1 provided with the toner recycling system shown in FIG. 6(*b*) are used, and image forming experiments have been conducted with the following condition, with regard to a photoconductor as the photoreceptor, an exposure unit, a developing unit, a cleaning roller and a cleaning blade etc.

Photoconductor (Photoreceptor)

As an organic photoconductive material, phthlocyanine pigment is used. The pigment is dispersed in polycarbonate resin and coated on an electro-conductive drum made of aluminum to form a photoconductive layer having the thickness of 25 μm.

Exposure Unit (Exposure Means)

An exposure unit for conducting a scanning exposure, comprises a laser diode as the light source, and a scanning optics having a polygon mirror, a lens and a mirror.

Developing Unit (Developing Means)

A developing unit for conducting a reversal development with dual-component developer, comprises a developing sleeve which rotates with the line speed of 370 mm/sec and is applied a bias voltage of the same polarity as the photoconductor's potential.

Cleaning Roller

An electro-conductive roller consisting of foamed urethane having the surface resistivity of $10^6$ Ωcm.

The cleaning roller is rotated to move in the same direction at the contact point with photoreceptor, by the driving system branched from the driving system for the photoreceptor, and toner on the surface of the roller is removed by several kinds of toner collecting members, such as a scraper, shown in table 2.

Electrical Current of Bias Voltage Applied to the Cleaning Roller

| | |
|---|---|
| Until 50,000 sheets of formed images: | +5 μA |
| 50,001–100,000 sheets: | +15 μA |
| 100,001–150,000 sheets: | +30 μA |

With regard to the power source, a constant current power supply was used. Incidentally, the polarity of the current from the cleaning roller to the photoreceptor is defined as "+".

Cleaning Blade

A cleaning blade made of urethane rubber and having the hardness of 70°, the thickness of 2.00 mm, and the free length of 10 mm is made into contact with the photoreceptor, at the top edge portion of the blade, with the contact angle of 10° and the weight load of 5 g/cm.

Ambiance

Until 50,000 sheets, normal temperature and humidity (temperature of 20° C., relative humidity of 50%). 50,001–150,000 sheets, high temperature and humidity (temperature of 30° C., relative humidity of 80%).

Incidentally, durability of the cleaning blade used in the experiment is 150,000 sheets of images.

In the experiment, after 150,000 sheets of images are formed, the cleaning blade is exchanged and another 150,000 sheets of images are made in the above environment, to make total of 300,000 sheets of images.

In Example 13 and Reference 4 that are shown in Table 2, which will be shown later, constant voltage biases were applied to the cleaning rollers. In Example 13, applied voltage was 50 V until 50,000 sheets, 100 V from 50,001 to 100,000 sheets, and 200 V from 100,001 to 150,000 sheets. In Example 4, applied voltage was 550 V until 50,000 sheets, 600 V from 50,001 to 100,000 sheets, and 800 V from 100,001 to 150,000 sheets.

(2) Manufacturing the Example Toner (1. Example of Emulsion Polymerization Method)

There were poured 0.90 kg of n-dodecyl sodium sulfate and 10.0 liters of pure water, and they were stirred and dissolved. To this solution, there was added slowly 1.20 kg of Regal 330R (carbon black made by Cabot Co.), and after stirring sufficiently for one hour, a sand grinder (homogenizer of a medium type) was used to disperse continuously for 20 hours. Let it be assumed that this solution is "Colorant dispersing solution 1".

Further, a solution composed of 0.055 kg of dodecyl sodium benzenesulfonic and 4.0 liters of ion-exchange water is assumed to be "Anion surfactant solution A".

A solution composed of 0.014 kg of nonylphenol polyethylene oxide 10 mol adduct and 4.0 liters of ion-exchange water is assumed to be "Nonion surfactant solution B".

A solution wherein 223.8 g of potassium persulfate is dissolved in 12.0 liters of ion-exchange water is assumed to be "Initiator solution C".

In a 100-liter GL (glass lining) reaction vessel equipped with a temperature sensor, a cooling pipe and a nitrogen introducing device, there were poured 3.41 kg of WAX emulsion (polypropylene emulsion of number average molecular weight: number average primary particle diameter=120 nm/solid matters density=29.9%), the whole of "Anion surfactant solution A" and the whole of "Nonion surfactant solution B", and stirring was initiated. The structure of stirring blade shown in FIG. 15 was applied. Then, 44.0 liters of ion-exchange water was added.

Heating was started, and when the solution temperature was raised to 75° C., the whole of "Initiator solution C" was added. After that, 12.1 kg of styrene, 2.88 kg of acrylic acid n-butyl, 1.04 kg of methacrylic acid and 548 g of t-dodecyl mercaptan were added through dropping, while keeping the solution temperature at 75° C.±1° C. After completion of the dropping, the solution temperature was raised to 80° C.±1° C., and heating and stirring were carried out for six hours. Then, the solution temperature was lowered to 40° C. or lower and stirring was stopped to obtain latex after filtering with pole-filter. This is assumed to be "Latex 1-A".

Incidentally, the glass transition temperature of a resin particle in latex A was 57° C., a softening point was 121° C., weight average molecular weight was 12,700 in terms of molecular weight distribution, and weight average particle diameter was 120 nm.

Further, a solution wherein 0.055 kg of dodecyl sodium benzenesulfonic is dissolved in 4.0 liters of ion-exchange water is assumed to be "Anion surfactant solution D".

A solution wherein 0.014 kg of nonylphenol polyethylene oxide 10 mol adduct is dissolved in 4.0 liters of ion-exchange water is assumed to be "Nonion surfactant solution E".

A solution wherein 200.7 g of potassium persulfate (made by Kanto Kagaku Co.) is dissolved in 12.0 liters of ion-exchange water is assumed to be "Initiator solution F".

In a 100-liter GL (glass lining) reaction vessel equipped with a temperature sensor, a cooling pipe, a nitrogen introducing device and a comb-shaped baffle, there were poured 3.41 kg of WAX emulsion (polypropylene emulsion of number average molecular weight: number average primary particle diameter=120 nm/solid matters density=29.9%), the whole of "Anion surfactant solution D" and the whole of "Nonion surfactant solution E", and stirring was initiated.

Then, 44.0 liters of ion-exchange water was added. Heating was started, and when the solution temperature was raised to 70° C., "Initiator solution F" was added. Then, a solution wherein 11.0 kg of styrene, 4.00 kg of acrylic acid n-butyl, 1.04 kg of methacrylic acid and 9.02 g of t-dodecyl mercaptan were mixed in advance was dropped. After completion of the dropping, the solution temperature was controlled to 72° C.±2° C., and heating and stirring were carried out for six hours. The solution temperature was further raised to 80° C.±2° C. and heating and stirring were conducted for 12 hours. The solution temperature was lowered to 40° C. or lower and stirring was stopped. Filtering was conducted with pole-filter, and this filtered solution was assumed to be "Latex 1-B".

Incidentally, the glass transition temperature of a resin particle in latex 1-B was 58° C., a softening point was 132° C., weight average molecular weight was 245000 in terms of molecular weight distribution, and weight average particle diameter was 110 nm.

A solution wherein 5.36 kg of sodium chloride representing a salting-out agent is dissolved in 20.0 liters of ion-exchange water is assumed to be "Sodium chloride solution G".

A solution wherein 1.00 g of fluorine Nonion surfactant is dissolved in 1.00 liter of ion-exchange water is assumed to be "Nonion surfactant solution H".

In a 100-liter SUS reaction vessel (stirring blade has the structure shown in FIG. 10(*a*)) equipped with a temperature sensor, a cooling pipe, a nitrogen introducing device and a monitoring apparatus for a particle diameter and a form, there were poured 20.0 kg of latex 1-A and 5.2 kg of latex 1-B prepared in the way stated above, 0.4 kg of coloring agent dispersed solution and 20.0 kg of ion-exchange water, and they were stirred. Then, the solution was heated to 40° C., and sodium chloride solution G, 6.00 kg of isopropanol (made by Kanto Kagaku Co.) and Nonion surfactant solution H were added to the solution in this order. After that, they were left for 10 minutes, then, raising temperature was started and continued for 60 minutes until the solution temperature reached 85° C. The solution was heated and stirred for salting-out and fusion to allow a particle diameter to grow, while keeping the temperature of 85° C.±2° C. Then, 2.1 liters of pure water was added to stop the growth of the particle diameter.

In a 5-liter reaction vessel (stirring blade has the structure shown in FIG. 10(*a*)) equipped with a temperature sensor, a cooling pipe and a monitoring apparatus for a particle diameter and a form, there was poured 5.0 kg of fusion particle dispersed solution prepared in the aforesaid way, and the solution was heated and stirred for 0.5–15 hours at the solution temperature of 85° C.±2° C. so that the form may be controlled. After that, the solution was cooled down to 40° C. or lower and stirring was stopped. Then, classification was conducted in the solution by a centrifugal sedimentation method by using a centrifuge, and filtering was conducted with a filter having a mesh of 4.5 μm, resulting in a filtered solution, which is an "association solution 1". Then, wet-cake-shaped non-spherical particles were obtained from the association solution 1 through filtering, by the use of a Nutsche filter. After that, they were washed with ion-exchange water.

These non-spherical particles were dried by a flash-jet drier at air temperature of 60° C., and then, dried by a fluid bed drier at the temperature of 60° C. Then silica fine particles of 1 part by weight was added and mixed with 100 parts by weight of the above colored particles by using Henshell mixer to obtain the toner manufactured by emulsification polymerization association method.

In monitoring of the aforementioned salting-out and fusion step and the form controlling process, the shape and the variation coefficient of shape factor were controlled by adjusting the number of revolutions for stirring and heating time, and further, the particle diameter and the variation coefficient of the particle size distribution were controlled by means of the classification in solution, thus, colored particle shown in Table 1 of Toner 1–4, Toner 6–7 and Toner 10 were obtained.

(2. Example of Suspension Polymerization Method)

Styrene 165 g, n-butylacrylate 35 g, carbon black 10 g, di-t-butylsalicylate metal compound 2 g, styrene-methacrylate copolymer 8 g, paraffin wax (mp=70° C.) 20 g were warmed to 60° C. and melted and dispersed by TK Homomixer (made by TOKUSYUKIKA KOUGYOU). Then, as the polymerization initiator, 10 g of 2,2'-azobis (2, 4 valeronitrile) was added and solved to prepare a polymerizable monomer composition. Nextly, 450 g of 0.1 Mol sodium phosphate aqueous solution was added to 710 g of ion exchange water, and while stirring by TK Homomixer with 3,000 rpm, 68 g of 1.0 Mol calcium chloride were gradually added and a suspension, in which tri-potassium phosphate was dispersed, was prepared. In this suspension, the above polymerizable monomer composition was added and stirred by TK Homomixer with 10,000 rpm for 20 minutes to granulate the polymerizable monomer composition. After that, using the reaction apparatus having a stirring blade shown in FIG. 15, reaction was conducted at 75 to 95° C. for 5 to 15 hours. Then, tri-potassium phosphate was dissolved by hydrochloric acid and the reactant was filtered, washed and dried. One part by weight of silica fine particles was added to 100 parts by weight of the obtained colored particle, and mixed by Henshell Mixer to obtain the toner manufactured by suspension polymerization method.

While monitoring the aforementioned polymerization process, the shape and the variation coefficient of shape factor were controlled by adjusting the temperature, the number of revolutions for stirring and heating time, and further, the particle diameter and the variation coefficient of the particle size distribution were controlled by means of the classification in solution, thus, colored particle shown in Table 1 of Toner 5 and Toner 9 were obtained.

(3. Example of Pulverization Method)

The primary material consisting of; 100 kg of styrene-n-butylacrylate copolymer resin, 10 kg of carbon black and 4 parts by weight of polypropylene was preliminary mixed by Henshell Mixer, and was coarsely pulverized by Hammer mill and further pulverized by Jet pulverizer, and the powder obtained was disperses into heated air-stream (for 0.005 sec. at 200–300° C.) to obtain shape controlled particles. These particles were repeatedly classified by a wind-classifier until obtaining the aimed particle diameter distribution, and mixed by Henshell Mixer to obtain the toner manufactured by pulverization method.

In this way, the shape and the variation coefficient of shape factor were controlled, and further, the particle diameter and the variation coefficient of the particle size distribution were controlled to obtain the toner, shown in Table 1, of Toner 8, Toner 11 and Toner 12.

TABLE 1

| Developer No. | Toner No. | Charge amount (μC/g) | Average degree of circularity: Shape factor | Average degree of circularity: CV value (%) | Particle size distribution rate Dv/Dp | Rate of toner particles having no corner (%) | Number average Sum M of m1 and m2 (%) | Number average of particle diameter (μm) | Manufacturing method of toner |
|---|---|---|---|---|---|---|---|---|---|
| 1 | Toner 1 | 25 | 0.930 | 19 | 1.29 | 58 | 72 | 4.5 | Emulsion association |
| 2 | Toner 2 | 23 | 0.950 | 9 | 1.12 | 72 | 73 | 5.8 | Emulsion association |
| 3 | Toner 3 | 27 | 0.995 | 8 | 1.18 | 74 | 70 | 6.5 | Emulsion association |
| 4 | Toner 4 | 35 | 1.000 | 18 | 1.01 | 60 | 71 | 3.9 | Emulsion association |
| 5 | Toner 5 | 50 | 0.994 | 6 | 1.32 | 48 | 65 | 3.1 | Suspension Polymerization |
| 6 | Toner 6 | 23 | 0.925 | 22 | 1.15 | 47 | 64 | 6.8 | Emulsion association |
| 7 | Toner 7 | 20 | 0.923 | 24 | 1.34 | 70 | 63 | 7.2 | Emulsion association |
| 8 | Toner 8 | 17 | 0.920 | 23 | 0.98 | 40 | 62 | 9.0 | Pulverization |
| 9 | Toner 9 | 40 | 0.968 | 7 | 1.13 | 57 | 74 | 2.9 | Emulsion association |
| 10 | Toner 10 | 22 | 0.963 | 8 | 1.25 | 58 | 71 | 9.2 | Emulsion association |
| 11 | Toner 11 | 16 | 0.924 | 24 | 1.35 | 41 | 60 | 12.0 | Pulverization |
| 12 | Toner 12 | 15 | 0.918 | 25 | 0.95 | 39 | 59 | 2.0 | Pulverization |

(Manufacturing of Developer)

Ferrite carrier which is covered with styrene-methacrylate copolymer and has an average particle diameter of 45 μm was mixed with each of Toner 1 to Toner 12 with the ratio of toner 19.8 g to ferrite carrier 200.2 g, and Developer 1 to Developer 12 for evaluation were prepared.

(Evaluation by the Image Forming Apparatus)

Toner collecting members, biasing means for the cleaning roller, and Developers 1 to 12 are made combinations as shown in Table 2, and image forming evaluations were conducted.

TABLE 2

| No. | Developer No. | Toner collecting member: Number of members | Toner collecting member: Kind of member | Toner collecting member: Arrangement | Applied bias voltage |
|---|---|---|---|---|---|
| Example 1 | Developer 1 | 2 | Scraper | Counter | Constant current |
| Example 2 | Developer 2 | 2 | Scraper | Trail | Constant current |
| Example 3 | Developer 3 | 2 | Scraper | Counter | Constant current |
| Example 4 | Developer 4 | 2 | Scraper | Trail | Constant current |
| Example 5 | Developer 5 | 2 | Scraper | Trail | Constant current |
| Example 6 | Developer 6 | 2 | Scraper | Counter | Constant current |
| Example 7 | Developer 7 | 2 | Scraper | Counter | Constant current |
| Example 8 | Developer 9 | 2 | Scraper | Counter | Constant current |
| Example 9 | Developer 10 | 2 | Scraper | Counter | Constant current |
| Example 10 | Developer 2 | 1 | Scraper | — | Constant current |
| Example 11 | Developer 2 | 2 | Contact bias roller | Counter | Constant current |
| Example 12 | Developer 2 | 2 | Fur brush | Counter | Constant current |
| Example 13 | Developer 2 | 2 | Non-contact bias roller | Counter | Constant voltage |
| Example 14 | Developer 2 | 2 | Scraper | Counter | Constant current |
| Reference 1 | Developer 2 | — | — | — | Not applied |

TABLE 2-continued

| No. | Developer No. | Toner collecting member: Number of members | Toner collecting member: Kind of member | Toner collecting member: Arrangement | Applied bias voltage |
|---|---|---|---|---|---|
| Reference 2 | Developer 8 | 2 | Scraper | Counter | Constant current |
| Reference 3 | Developer 11 | 2 | Scraper | Counter | Constant current |
| Reference 4 | Developer 11 | 1 | Scraper | — | Constant voltage |
| Reference 5 | Developer 2 | 2 | Scraper | Counter | Not applied |

Evaluation:

Based on the abovementioned image forming conditions, image forming was conducted, and at the beginning of image formation and after each of 50,000 sheets, 100,000 sheets, 150,000 sheets of image formation, images for evaluation were made sheet by sheet intermittently. As for images for evaluation, solid black image, halftone image, and solid white image were formed and were subjected to the evaluation regarding generation of image smudges or character image scattering, image density, background fog density, and existence of unevenness in halftone image. The image smudges and the character image scattering were evaluated by visual observation by using a loupe, and evenness of halftone images were judged by visual observation and these results were evaluated with ranks described later. In all the evaluations, rank A and rank B are defined to be accepted.

As the image density, absolute reflection density was measured by using a densitometer RD-918 (made by Macbeth Co.). The background fog density was measured as a relative reflection density by adjusting a reflection density of transfer paper to zero.

(Image Smudges)

Rank A: No image smudge.

Rank B: Existence of extremely pale smudge is confirmed under a loupe, with no practical problem.

Rank C: Several slight image smudges were confirmed by visual observation. Practically not accepted.

Rank D: Several obvious image smudges were confirmed by visual observation. Practically not accepted.

(Character Image Scattering)

Rank A: No image scattering.

Rank B: Existence of extremely small amount of image scattering is confirmed under a loupe, with no practical problem.

Rank C: Several aggregated image scatterings were confirmed by visual observation. Practically not accepted.

Rank D: Several obvious aggregated image scatterings were confirmed by visual observation. Practically not accepted.

(Unevenness in Halftone Image)

Rank A: Even halftone image without unevenness.

Rank B: Existence of slight streaky unevenness is confirmed, with no practical problem.

Rank C: Several streaky unevenness were confirmed. Practically not accepted.

Rank D: Several obvious streaky unevenness were confirmed. Practically not accepted.

Results of the observation were shown in Table 3 and Table 4.

As it is obvious from the results shown in Table 3 and Table 4, all the Examples of the present invention were shown to have properties for being acceptable for practical use. On the other hand, each of the References, which are beyond the scope of the present invention, is confirmed to have at least a problem in any of the properties.

According to the present invention, an image forming apparatus and an image forming method, where a small particle sized polymerized toner remained on a photoreceptor can be surely removed and collected, are attained by combining an electrical cleaning having a cleaning roller being applied a voltage from a constant current power source, with a mechanical cleaning having a cleaning blade.

Further, the present invention established a toner recycling technology where the toner removed from the photoreceptor by the cleaning roller and collected is returned to the developing means and is subjected to reuse for an image formation.

TABLE 3

| | Image smudges | | | | Character image scattering | | | | Image density | | | |
|---|---|---|---|---|---|---|---|---|---|---|---|---|
| | Beginning | 50,000 sheets | 100,000 sheets | 150,000 sheets | Beginning | 50,000 sheets | 100,000 sheets | 150,000 sheets | Beginning | 50,000 sheets | 100,000 sheets | 150,000 sheets |
| Example 1 | A | A | A | A | A | A | A | A | 1.40 | 1.39 | 1.39 | 1.38 |
| Example 2 | A | A | A | A | A | A | A | A | 1.41 | 1.41 | 1.40 | 1.40 |
| Example 3 | A | A | A | A | A | A | A | A | 1.42 | 1.42 | 1.41 | 1.41 |
| Example 4 | A | A | A | A | A | A | A | A | 1.40 | 1.40 | 1.39 | 1.39 |
| Example 5 | A | A | A | A | A | A | B | B | 1.41 | 1.40 | 1.40 | 1.39 |
| Example 6 | A | A | A | B | A | A | B | B | 1.40 | 1.39 | 1.39 | 1.38 |
| Example 7 | A | A | A | B | A | A | A | B | 1.42 | 1.41 | 1.40 | 1.38 |
| Example 8 | A | A | A | A | A | A | A | B | 1.43 | 1.42 | 1.41 | 1.40 |
| Example 9 | A | A | B | B | A | A | B | B | 1.41 | 1.40 | 1.39 | 1.38 |
| Example 10 | A | A | A | A | A | A | A | B | 1.40 | 1.40 | 1.39 | 1.38 |
| Example 11 | A | A | A | A | A | A | A | A | 1.42 | 1.41 | 1.41 | 1.40 |
| Example 12 | A | A | A | A | A | A | A | B | 1.41 | 1.40 | 1.40 | 1.40 |
| Example 13 | A | A | B | B | A | B | B | B | 1.42 | 1.41 | 1.40 | 1.38 |
| Example 14 | A | A | B | B | A | B | B | B | 1.42 | 1.41 | 1.39 | 1.38 |
| Reference 1 | B | D | D | D | B | C | C | D | 1.43 | 1.28 | 1.21 | 1.13 |
| Reference 2 | A | C | C | D | A | C | C | D | 1.41 | 1.25 | 1.20 | 1.14 |
| Reference 3 | A | C | D | D | A | C | C | D | 1.42 | 1.23 | 1.14 | 1.09 |
| Reference 4 | A | C | C | C | B | C | C | D | 1.41 | 1.26 | 1.10 | 1.08 |
| Reference 5 | A | D | D | D | A | C | D | D | 1.42 | 1.27 | 1.08 | 1.05 |

TABLE 4

| | Background fog density | | | | Unevenness in halftone image | | | |
|---|---|---|---|---|---|---|---|---|
| | Beginning | 50,000 sheets | 100,000 sheets | 150,000 sheets | Beginning | 50,000 sheets | 100,000 sheets | 150,000 sheets |
| Example 1 | 0.000 | 0.001 | 0.001 | 0.002 | A | A | A | A |
| Example 2 | 0.000 | 0.001 | 0.002 | 0.002 | A | A | A | A |
| Example 3 | 0.000 | 0.001 | 0.001 | 0.002 | A | A | A | A |
| Example 4 | 0.000 | 0.001 | 0.002 | 0.002 | A | A | A | A |
| Example 5 | 0.000 | 0.001 | 0.001 | 0.003 | A | A | A | A |
| Example 6 | 0.000 | 0.001 | 0.002 | 0.004 | A | A | B | B |
| Example 7 | 0.000 | 0.002 | 0.003 | 0.004 | A | A | A | B |
| Example 8 | 0.000 | 0.002 | 0.003 | 0.005 | A | A | A | A |
| Example 9 | 0.000 | 0.003 | 0.004 | 0.008 | A | A | B | B |
| Example 10 | 0.000 | 0.007 | 0.007 | 0.003 | A | A | A | B |
| Example 11 | 0.000 | 0.002 | 0.002 | 0.003 | A | A | A | A |
| Example 12 | 0.000 | 0.002 | 0.002 | 0.003 | A | A | A | A |
| Example 13 | 0.000 | 0.006 | 0.007 | 0.008 | A | A | A | B |
| Example 14 | 0.000 | 0.007 | 0.008 | 0.008 | A | A | B | B |
| Reference 1 | 0.000 | 0.012 | 0.016 | 0.019 | A | C | D | D |
| Reference 2 | 0.000 | 0.013 | 0.015 | 0.018 | A | C | C | C |
| Reference 3 | 0.000 | 0.010 | 0.016 | 0.019 | A | C | C | C |
| Reference 4 | 0.000 | 0.011 | 0.014 | 0.017 | A | C | C | D |
| Reference 5 | 0.000 | 0.013 | 0.018 | 0.021 | A | C | D | D |

Furthermore, the present invention focused to the characteristics of toner particles used for image formation, and achieved a remarkable improvement in cleaning performance for small particle sized polymerized toner, by controlling to apply even shaped toner particles, toner having a particle size distribution in specific range, and toner in which toner particles having no corner exist more a specific percentage.

What is claimed is:

1. An image forming apparatus comprising:

an image carrier having a photosensitive surface layer;

a developing device for making a toner image by developing a latent image formed on the image carrier by using a toner comprising resin particles, which are obtained through particle formation in an aqueous medium;

a transfer device for transferring the toner image on the image carrier onto a transfer material; and a cleaning device for removing residual toner remaining on the image carrier after transferring, wherein the cleaning device comprises:

a cleaning roller having a conductive or semi-conductive resilient body;

a cleaning blade made of a resilient material and provided downstream from the cleaning roller in the moving direction of the image carrier;

a power source to apply a bias voltage on the cleaning roller; and a collecting member to collect the toner removed by the cleaning roller;

wherein the absolute value of the charge amount of the toner used in the image forming apparatus is not less than 20 μC/g and not more than 50 μC/g, and wherein Dv and Dp of the toner used in the image forming apparatus have the relation expressed in the following formula:

$$1.3>Dv/Dp>1.0$$

wherein, Dv is volume average particle diameter, and Dp is particle number average particle diameter.

2. The image forming apparatus of claim 1, wherein the cleaning device comprises a plurality of collecting members to collect the toner removed by the cleaning roller.

3. The image forming apparatus of claim 1, wherein the power source, to apply a bias voltage on the cleaning roller, is a constant current type power source.

4. The image forming apparatus of claim 1, further comprises a toner recycling device for returning the toner collected by the collecting member to the developing device to make a toner image by developing the latent image formed on the image carrier.

5. The image forming apparatus of claim 1, wherein the toner used in the image forming apparatus has a degree of circularity not less than 0.930 and not more than 1.000.

6. The image forming apparatus of claim 1, wherein the toner used in the image forming apparatus comprises toner particles, which include 50 number % or more of the toner particles having no corner.

7. The image forming apparatus of claim 1, wherein the toner used in the image forming apparatus comprises toner particles, in which the particle number average of the toner particles is not less than 3 μm and not larger than 9 μm.

8. An image forming apparatus comprising:

an image carrier having a photosensitive surface layer;

a developing device for making a toner image by developing a latent image formed on the image carrier by using a toner comprising resin particles, which are obtained through particle formation in an aqueous medium;

a transfer device for transferring the toner image on the image carrier onto a transfer material; and a cleaning device for removing residual toner remaining on the image carrier after transferring, wherein the cleaning device comprises:

a cleaning roller having a conductive or semi-conductive resilient body;

a cleaning blade made of a resilient material and provided downstream from the cleaning roller in the moving direction of the image carrier;

a power source to apply a bias voltage on the cleaning roller;

a collecting member to collect the toner removed by the cleaning roller; and wherein the absolute value of the charge amount of the toner used in the image forming apparatus is not less than 20 μC/g and not more than 50 μC/g, and wherein the toner used in the image forming apparatus comprises toner particles wherein, when D (μm) represents a particle diameter of a toner particle, the sum total (M) of relative frequency (m1) of the toner particles included in the most frequent rank and relative frequency (m2) of toner particles included in the second highest frequent rank if 70% or more, in the histogram showing the particle size distribution of the number basis, wherein the horizontal axis is represented by natural logarithm 1 nD and said horizontal axis is divided into plural ranks at an interval of 0.23.

9. The image forming apparatus of claim 1, wherein the toner used in the image forming apparatus comprises toner particles obtained by association of resin particles in an aqueous medium.

10. An image forming method comprising:

forming a latent image on an image carrier having a photosensitive surface layer;

making a toner image by developing the latent image with a toner comprising resin particles which are obtained through particle formation in an aqueous medium;

transferring the toner image on the image carrier onto a transfer material;

removing residual toner remaining on the image carrier after transferring, wherein removal of the residual toner is performed by both a cleaning roller having a conductive or semi-conductive resilient body, and a cleaning blade made of a resilient material and provided downstream the cleaning roller in the moving direction of the image carrier; and collecting toner removed by the cleaning roller;

wherein the absolute value of the charge amount of the toner used in the image forming method is not less than 20 μC/g and not more than 50 μC/g, and wherein Dv and Dp of the toner used in the image forming apparatus have the relation expressed in the following formula:

$$1.3>Dv/Dp>1.0$$

wherein, Dv is volume average particle diameter, and Dp is particle number average particle diameter.

11. The image forming method of claim 10, wherein the cleaning roller is supplied with a bias voltage by a constant current type power source to remove the residual toner.

12. The image forming method of claim 10, further comprises a step of returning the toner collected by a toner collecting member into the developing device to make a toner image by developing the latent image formed on the image carrier.

13. The image forming method of claim 10, wherein the toner used for making the toner image has a degree of circularity not less than 0.930 and not more than 1.000.

14. The image forming method of claim 10, wherein the toner used for making the toner image comprises toner particles, which include 50 number % or more of the toner particles having no corner.

15. The image forming method of claim 10, wherein the toner used for making the toner image comprises toner particles, the particle number average of the toner particles being not less than 3 μm and not greater than 9 μm.

16. The image forming method of claim 10, wherein the toner used for making the toner image comprises toner particles obtained by association of resin particles in an aqueous medium.

17. An image forming method comprising:

forming a latent image on an image carrier having a photosensitive surface layer;

making a toner image by developing the latent image with a toner comprising resin particles which are obtained through particle formation in an aqueous medium;

transferring the toner image on the image carrier onto a transfer material;

removing residual toner remaining on the image carrier after transferring, wherein removal of the residual toner is performed by both a cleaning roller having a conductive or semi-conductive resilient body, and a cleaning blade made of a resilient material and provided downstream the cleaning roller in the moving direction of the image carrier; and collecting toner removed by the cleaning roller;

wherein the absolute value of the charge amount of the toner used in the image forming method is not less than 20 μC/g and not more than 50 μC/g, and wherein the toner used for making the toner image comprises toner particles wherein, when D (μm) represents a particle diameter of toner particles, the sum total (M) of relative frequency (m1) of the toner particles included in the most frequent rank and relative frequency (m2) of toner particles included in the second highest frequent rank is 70% or more, in the histogram showing the particle size distribution of the number basis wherein the horizontal axis is represented by natural logarithm 1 nD and this horizontal axis is divided into plural ranks at an interval of 0.23.

* * * * *